US006096494A

United States Patent [19]

Tang et al.

[11] Patent Number: 6,096,494

[45] Date of Patent: Aug. 1, 2000

[54] SILVER HALIDE PHOTOGRAPHIC ELEMENT CONTAINING IMPROVED CYAN DYE-FORMING PHENOLIC COUPLER

[75] Inventors: Ping-Wah Tang, Yorktown Heights; Margaret D. Steele, Webster, both of N.Y.

[73] Assignee: Eastman Kodak Company, Rochester, N.Y.

[21] Appl. No.: 09/210,283

[22] Filed: Dec. 11, 1998

[51] Int. Cl.[7] ..... G03C 1/08; G03C 7/26; G03C 7/32

[52] U.S. Cl. ..... 430/553; 430/543; 430/552; 430/304; 430/305

[58] Field of Search ..... 430/543, 552, 430/553, 384, 385, 379

[56] References Cited

U.S. PATENT DOCUMENTS

| | | | |
|---|---|---|---|
| 2,895,826 | 7/1959 | Salminen et al. | 430/543 |
| 4,333,999 | 6/1982 | Lau | 430/552 |
| 4,341,864 | 7/1982 | Vandewalle et al. | 430/552 |
| 4,368,257 | 1/1983 | Usagawa et al. | 430/552 |
| 4,753,871 | 6/1988 | Kilminster et al. | 430/532 |
| 4,822,729 | 4/1989 | Monbaliu et al. | 430/552 |
| 4,923,791 | 5/1990 | Merkel et al. | 430/553 |
| 5,192,651 | 3/1993 | Tsukahara et al. | 430/553 |
| 5,597,684 | 1/1997 | Ikesu et al. | 430/553 |
| 5,681,690 | 10/1997 | Tang et al. | 430/552 |

FOREIGN PATENT DOCUMENTS 0396900 12/1994 European Pat. Off. .

*Primary Examiner*—Geraldine Letscher
*Attorney, Agent, or Firm*—Arthur E. Kluegel

[57] ABSTRACT

A color photographic element includes a support, a silver halide emulsion layer, and associated therewith a phenolic dye-forming coupler having the formula wherein $R^1$ represents hydrogen, a straight or branched chain alkyl group having 1 to about 20 carbon atoms, a cycloalkyl group having about 3 to 8 carbon atoms in the ring, or an aryl group having 6 to about 20 carbon atoms;

$R^2$ represents hydrogen or a substituent;

$R^3$ represents hydrogen, halogen, or alkyl, cycloalkyl or aryl groups as defined for $R^1$;

$R^4$ represents a fluorosubstituted alkyl group having 1 to about 20 carbon atoms, a fluorosubstituted cycloalkyl group having about 3 to 8 carbon atoms, or a fluoro-substituted aryl group having 6 to about 20 carbon atoms;

$R^5$ represents hydrogen or a substituent; X represents hydrogen or a coupling-off group; Z represents carbon atoms or hetero atoms necessary to complete a 5-,6-, or 7-membered ring; m is 0 to 3; and n is 0 to 4.

19 Claims, No Drawings

SILVER HALIDE PHOTOGRAPHIC ELEMENT CONTAINING IMPROVED CYAN DYE-FORMING PHENOLIC COUPLER

FIELD OF THE INVENTION

This invention relates to a color photographic element containing a cyan dye-forming coupler that provides high coupling activity, narrowed bandwidth, decreased pH sensitivity, and improved image dye stability, and has the following general structure:

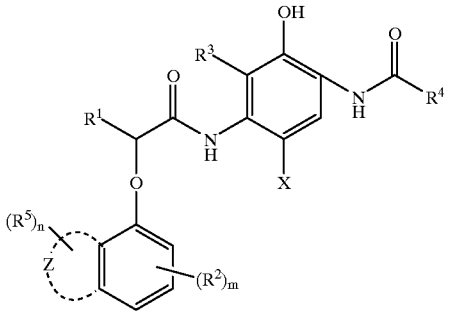

BACKGROUND OF THE INVENTION

Silver halide color photography depends on the formation of dyes in order to reproduce an image. These dyes are typically formed from couplers present in or adjacent to the light sensitive silver halide emulsion layers that react to image light upon exposure. During development, the latent image recorded by the silver halide emulsion is developed by a developer compound to amplify the image. During this process, in which silver halide is reduced to elemental silver, the developer compound is at the same time oxidized to a species which then reacts or couples with the coupler compound present in or adjacent to the emulsion layer to form a dye of the desired color.

Typically, a silver halide emulsion layer containing a cyan dye-forming coupler is sensitized to red light. This facilitates so-called negative-positive processing, in which the image is initially captured in a negative format where black is captured as white, white as black, and the colors as their respective complementary colors, e.g., green as magenta, blue as yellow, and red as cyan. Then the initial image can be optically printed in the correct colors on a reflective background through the device of optical printing, which has the effect of producing a negative of the negative or a positive of the image.

Reversal color photographic elements and processes are well known in the art. They are described, for example, in T. H. James, editor, "The Theory of the Photographic Process". Reversal color photographic materials processed by such reversal color processes are generally classified into two types, one in which silver halide emulsion layers contains couplers, the other in which the silver halide emulsion layers do not contain couplers.

A reversal color photographic process fundamentally comprises a first development step with a black and white developer, a second development step with a color developer, and a desilvering step. More specifically, when an exposed reversal color photographic material is developed in the first development step, the exposed portions of the material are blackened as a result of development, but the unexposed portions remain unchanged. In the second development step, the silver halide in the unexposed portions is color developed to form colored dye and black silver images. In the exposed portions of the material, where little or no silver halide remains after the first development, little or no color image is formed by the color developer. The color photographic material thus developed is then processed in a desilvering step, where developed silver ($Ag^o$) is oxidized by an oxidizing agent (bleach), and the oxidized silver is dissolved and removed from the color photographic material by a fixing agent or a silver halide complexing solvent. Thus, positive dye images are formed in the color photographic material. The desilvering step usually comprises a bleach step and a fix step or comprises a blix step (or bleach stabilization step) wherein bleaching and fixing (stabilization) are performed simultaneously.

It is important for a color coupler to show good dye-forming activity and also produce a desirable dye hue. In other words, a coupler must be capable of forming sufficient amount of dye density during the allowable development time of the process, and the dye formed by the reaction between the oxidized color developer must exhibit an absorption curve having a desirable wavelength, maximum absorption and shape so as to provide an accurate color rendition. Couplers that form cyan dyes upon reaction with oxidized color developer are described in such representative patents and publications as U.S. Pat. Nos. 3,041,236, 4,333,999; 4,883,746 and "Farbkupplereine Literature Uber-sicht" in *Agfa Mitteilungen, Band III,* pp. 156–175 (1961). One type of commonly used cyan dye-forming coupler includes phenol compounds having carbonamido substituent groups in the 2- and 5-positions of the phenolic aromatic nucleus. Examples of such couplers are disclosed in U.S. Pat. Nos.4,333,999 and 4,923,791. While such couplers have been considered useful in photographic layers, they typically exhibit relatively low activity and produce dyes with less than optimal absorption curves.

The problem to be solved is to provide a silver halide photographic element containing a cyan coupler that exhibits high coupling activity and forms a dye having desirable light absorption characteristics and excellent image stability, particularly under conditions of elevated heat and humidity.

SUMMARY OF THE INVENTION

The present invention is directed to a color photographic element comprising a support, a silver halide emulsion layer, and associated therewith a phenolic dye-forming coupler having the formula

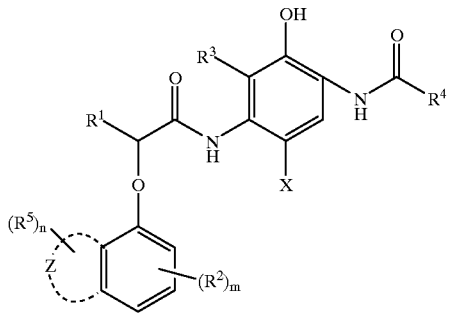

wherein $R^1$ represents hydrogen, a straight or branched chain alkyl group having 1 to about 20 carbon atoms, a cycloalkyl group having about 3 to 8 carbon atoms in the ring, or an aryl group having 6 to about 20 carbon atoms;

$R^2$ represents hydrogen or a substituent;

$R^3$ represents hydrogen, halogen, or alkyl, cycloalkyl or aryl groups as defined for $R^1$;

$R^4$ represents a fluorosubstituted alkyl group having 1 to about 20 carbon atoms, a fluorosubstituted cycloalkyl group having about 3 to 8 carbon atoms, or a fluorosubstituted aryl group having 6 to about 20 carbon atoms;

$R^5$ represents hydrogen or a substituent;

X represents hydrogen or a coupling-off group;

Z represents carbon atoms or hetero atoms necessary to complete a 5-,6-, or 7-membered ring;

m is 0 to 3; and n is 0 to 4.

The cyan couplers in the silver halide photographic element of the present invention exhibit high dye-forming activity and advantageously provide dyes having desirable light absorption characteristics and excellent image stability, particularly under conditions of elevated heat and humidity.

DETAILED DESCRIPTION OF THE INVENTION

In accordance with the present invention, a color photographic element includes a cyan dye-forming coupler having the formula

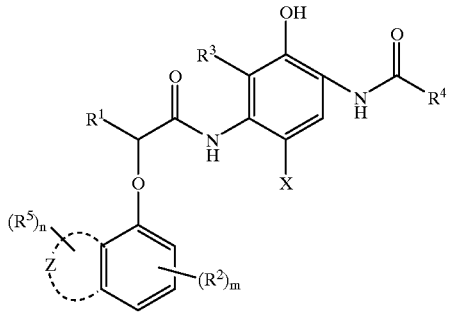

wherein $R^1$ represents hydrogen, a straight or branched chain alkyl group having 1 to about 20 carbon atoms, a cycloalkyl group having about 3 to 8 carbon atoms in the ring, or an aryl group having 6 to about 20 carbon atoms;

$R^2$ represents hydrogen or a substituent;

$R^3$ represents hydrogen, halogen, or alkyl, cycloalkyl or aryl groups as defined for $R^1$;

$R^4$ represents a fluorosubstituted alkyl group having 1 to about 20 carbon atoms, a fluorosubstituted cycloalkyl group having about 3 to 8 carbon atoms, or a fluorosubstituted aryl group having 6 to about 20 carbon atoms;

$R^5$ represents hydrogen or a substituent;

X represents hydrogen or a coupling-off group;

Z represents carbon atoms or hetero atoms necessary to complete a 5-,6-, or 7-membered ring;

m is 0 to 3; and n is 0 to 4.

The color photographic element of the present invention includes a support that can be, for example, a substantially transparent film support or a reflective paper support. The silver halide emulsion in the layer with which the phenolic coupler is associated and in which it can be incorporated is preferably a red-sensitized emulsion.

In the phenolic coupler of the present invention, $R^1$ is preferably an alkyl group having 1 to about 20 carbon atoms, and $R^2$ is preferably hydrogen, halogen, or an alkyl group containing 1 to about 3 carbon atoms. $R^3$ is preferably hydrogen, and $R^4$ is preferably a fluorosubstituted alkyl or aryl group, more preferably, a perfluorosubstituted alkyl group containing 1 to about 4 carbon atoms. $R^5$ is preferably hydrogen, an alkylsulfonyl group, or an arylsulfonyl group.

A dye-forming coupler having H at the coupling site is regarded as a 4-equivalent coupler, i.e., four equivalents of silver halide are required to convert one molecule of coupler into a dye molecule in the reaction with color developing agent. Coupling-off groups at the coupling site are well known in the art; they typically result in the coupler being 2-equivalent, i.e., only two equivalents of silver halide are required to generate a dye molecule from a coupler molecule. The presence of a coupling-off group can also affect the rate of dye formation, and the released coupling-off group itself can produce beneficial results in the associated silver halide emulsion layer or elsewhere in the photographic element.

Coupling-off groups, can be, for example, halogen, alkoxy, aryloxy, heterooxy, sulfonyloxy, acyloxy, sulfo, sulfonamido, mercaptotetrazolyl, benzothiazolyl, arylthio, and arylazo. In accordance with the present invention, X preferably represents, in addition to hydrogen, a halogen or an aryloxy coupling-off group, in particular, chlorine or a p-methoxyphenoxy group.

In accordance with the present invention, Z in the coupler structure represents a 5-, 6-, or 7-membered ring fused to the aryloxy moiety. For example, Z can represent four carbon atoms included within a naphth-1-oxy or naphth-2-oxy moiety; a sulfur atom, a carbon atom, and a nitrogen atom included within a benzothiazolyl-4-oxy or -5-oxy moiety; or two nitrogen atoms and a carbon atom included within a benzimidazolyl-4-oxy or -5-oxy moiety. Preferably, Z represents four carbon atoms necessary to form a fused 6-membered aryl group.

Also in accordance with the present invention, m and n are each independently preferably 0 or 1.

The color photographic element of the present invention can be adapted for negative color processing to give a color negative in colors complementary to those of the original image. This negative can be then be optically printed on a second negative photographic element to produce a positive of the original image therein. Alternatively, the photographic element of the invention can be adapted for reversal color photographic processing, as described above, to give a direct positive color image in the element.

Unless otherwise specifically stated, use of the term "substituted" or "substituent" means any group or atom other than hydrogen. Additionally, when the term "group" is used, it means that when a substituent group contains a substitutable hydrogen, it is also intended to encompass not only the substituent's unsubstituted form, but also its form further substituted with any substituent group or groups as herein mentioned, so long as the substituent does not destroy properties necessary for photographic utility. Suitably, a substituent group may be halogen or may be bonded to the remainder of the molecule by an atom of carbon, silicon, oxygen, nitrogen, phosphorous, or sulfur. The substituent may be, for example, halogen, such as chlorine, bromine or fluorine; nitro; hydroxyl; cyano; carboxyl; or groups which may be further substituted, such as alkyl, including straight or branched chain or cyclic alkyl, such as methyl, trifluoromethyl, ethyl, t-butyl, 3-(2,4-di-t-pentylphenoxy) propyl, and tetradecyl; alkenyl, such as ethylene, 2-butene; alkoxy, such as methoxy, ethoxy, propoxy, butoxy, 2-methoxyethoxy, sec-butoxy, hexyloxy, 2-ethylhexyloxy, tetradecyloxy, 2-(2,4-di-t-pentylphenoxy)ethoxy, and 2-dodecyloxyethoxy; aryl such as phenyl, 4-t-butylphenyl, 2,4,6-trimethylphenyl, naphthyl; aryloxy, such as phenoxy, 2-methylphenoxy, alpha- or beta-naphthyloxy, and 4-tolyloxy; carbonamido, such as acetamido, benzamido, butyramido, tetradecanamido, alpha-(2,4-di-t-pentylphenoxy)acetamido, alpha-(2,4-di-t-pentylphenoxy) butyramido, alpha-(3-pentadecylphenoxy)-hexanamido, alpha-(4-hydroxy-3-t-butylphenoxy)tetradecanamido, 2-oxo-pyrrolidin-1-yl, 2-oxo-5-tetradecylpyrrolin-1-yl, N-methyltetradecanamido, N-succinimido, N-phthalimido, 2,5-dioxo-1-oxazolidinyl, 3-dodecyl-2,5-dioxo-1-imidazolyl, and N-acetyl-N-dodecylamino, ethoxycarbonylamino, phenoxycarbonylamino, benzyloxycarbonylamino, hexadecyloxycarbonylamino, 2,4-di-t-butylphenoxycarbonylamino, phenylcarbonylamino, 2,5-(di-t-pentylphenyl) carbonylamino, p-dodecylphenylcarbonylamino, p-tolylcarbonylamino, N-methylureido, N,N-dimethylureido, N-methyl-N-dodecylureido, N-hexadecylureido, N,N-dioctadecylureido, N,N-dioctyl-N'-ethylureido, N-phenylureido, N,N-diphenylureido, N-phenyl-N-p-tolylureido, N-(m-hexadecylphenyl)ureido, N,N-(2,5-di-t-pentylphenyl)-N'-ethylureido, and t-butylcarbonamido; sulfonamido, such as methylsulfonamido, benzenesulfonamido, p-tolylsulfonamido, p-dodecylbenzenesulfonamido, N-methyltetradecylsulfonamido, N,N-dipropylsulfamoylamino, and hexadecylsulfonamido; sulfamoyl, such as N-methylsulfamoyl, N-ethylsulfamoyl, N,N-dipropylsulfamoyl, N-hexadecylsulfamoyl, N,N-dimethylsulfamoyl; N-[3-(dodecyloxy)propyl]sulfamoyl, N-[4-(2,4-di-t-pentylphenoxy)butyl]sulfamoyl, N-methyl-N-tetradecylsulfamoyl, and N-dodecylsulfamoyl; carbamoyl, such as N-methylcarbamoyl, N,N-dibutylcarbamoyl, N-octadecylcarbamoyl, N-[4-(2,4-di-t-pentylphenoxy)butyl]carbamoyl, N-methyl-N-tetradecylcarbamoyl, and N,N-dioctylcarbamoyl; acyl, such as acetyl, (2,4-di-t-amylphenoxy)acetyl, phenoxycarbonyl, p-dodecyloxyphenoxycarbonyl methoxycarbonyl, butoxycarbonyl, tetradecyloxycarbonyl, ethoxycarbonyl, benzyloxycarbonyl, 3-pentadecyloxycarbonyl, and dodecyloxycarbonyl; sulfonyl, such as methoxysulfonyl, octyloxysulfonyl, tetradecyloxysulfonyl, 2-ethylhexyloxysulfonyl, phenoxysulfonyl, 2,4-di-t-pentylphenoxysulfonyl, methylsulfonyl, octylsulfonyl, 2-ethylhexylsulfonyl, dodecylsulfonyl, hexadecylsulfonyl, phenylsulfonyl, 4-nonylphenylsulfonyl, and p-tolylsulfonyl; sulfonyloxy, such as dodecylsulfonyloxy, and hexadecylsulfonyloxy; sulfinyl, such as methylsulfinyl, octylsulfinyl, 2-ethylhexylsulfinyl, dodecylsulfinyl, hexadecylsulfinyl, phenylsulfinyl, 4-nonylphenylsulfinyl, and p-tolylsulfinyl; thio, such as ethylthio, octylthio, benzylthio, tetradecylthio, 2-(2,4-di-t-pentylphenoxy)ethylthio, phenylthio, 2-butoxy-5-t-octylphenylthio, and p-tolylthio; acyloxy, such as acetyloxy, benzoyloxy, octadecanoyloxy, p-dodecylamidobenzoyloxy, N-phenylcarbamoyloxy, N-ethylcarbamoyloxy, and cyclohexylcarbonyloxy; amine, such as phenylanilino, 2-chloroanilino, diethylamine, dodecylamine; imino, such as 1-(N-phenylimido)ethyl, N-succinimido or 3-benzylhydantoinyl; phosphate, such as dimethylphosphate and ethylbutylphosphate; phosphite, such as diethyl and dihexylphosphite; a heterocyclic group, a heterocyclic oxy group or a heterocyclic thio group, each of which may be substituted and which contain a 3 to 7 membered heterocyclic ring composed of carbon atoms and at least one hetero atom selected from the group consisting of oxygen, nitrogen and sulfur, such as 2-furyl, 2-thienyl, 2-benzimidazolyloxy or 2-benzothiazolyl; quaternary ammonium, such as triethylammonium; and silyloxy, such as trimethylsilyloxy.

If desired, the substituents may themselves be further substituted one or more times with the described substituent groups. The particular substituents used may be selected by those skilled in the art to attain the desired photographic properties for a specific application and can include, for example, hydrophobic groups, solubilizing groups, blocking groups, releasing or releasable groups, etc. When a molecule may have two or more substituents, the substituents may be joined together to form a ring such as a fused ring unless otherwise provided. Generally, the above groups and substituents thereof may include those having up to 48 carbon atoms, typically 1 to 36 carbon atoms and usually less than 24 carbon atoms, but greater numbers are possible depending on the particular substituents selected.

The materials of the invention can be used in any of the ways and in any of the combinations known in the art. Typically, the invention materials are incorporated in a melt and coated as a layer described herein on a support to form part of a photographic element. When the term "associated" is employed, it signifies that a reactive compound is in or adjacent to a specified layer where, during processing, it is capable of reacting with other components.

To control the migration of various components, it may be desirable to include a high molecular weight hydrophobe or "ballast" group in coupler molecules. Representative ballast groups include substituted or unsubstituted alkyl or aryl groups containing 8 to 48 carbon atoms. Representative substituents on such groups include alkyl, aryl, alkoxy, aryloxy, alkylthio, hydroxy, halogen, alkoxycarbonyl, aryloxcarbonyl, carboxy, acyl, acyloxy, amino, anilino, carbonamido, carbamoyl, alkylsulfonyl, arylsulfonyl, sulfonamido, and sulfamoyl groups wherein the substituents typically contain 1 to 42 carbon atoms. Such substituents can also be further substituted.

The photographic elements can be single color elements or multicolor elements. Multicolor elements contain image dye-forming units sensitive to each of the three primary regions of the spectrum. Each unit can comprise a single emulsion layer or multiple emulsion layers sensitive to a given region of the spectrum. The layers of the element, including the layers of the image-forming units, can be arranged in various orders as known in the art. In an alternative format, the emulsions sensitive to each of the three primary regions of the spectrum can be disposed as a single segmented layer.

A typical multicolor photographic element comprises a support bearing a cyan dye image-forming unit comprised of at least one red-sensitive silver halide emulsion layer having associated therewith at least one cyan dye-forming coupler, a magenta dye image-forming unit comprising at least one green-sensitive silver halide emulsion layer having associated therewith at least one magenta dye-forming coupler, and a yellow dye image-forming unit comprising at least one blue-sensitive silver halide emulsion layer having associated therewith at least one yellow dye-forming coupler. The element can contain additional layers, such as filter layers, interlayers, overcoat layers, subbing layers, and the like.

If desired, the photographic element can be used in conjunction with an applied magnetic layer as described in *Research Disclosure,* November 1992, Item 34390 published by Kenneth Mason Publications, Ltd., Dudley Annex, 12a North Street, Emsworth, Hampshire P010 7DQ, ENGLAND, and as described in Hatsumi Kyoukai Koukai Gihou No. 94-6023, published Mar. 15, 1994, available from the Japanese Patent Office, the contents of which are incorporated herein by reference. When it is desired to employ the inventive materials in a small format film, *Research Disclosure,* June 1994, Item 36230, provides suitable embodiments.

In the following discussion of suitable materials for use in the emulsions and elements of this invention, reference will be made to *Research Disclosure,* September 1996, Item 38957, available as described above, which is referred to herein by the term "Research Disclosure". The contents of the Research Disclosure, including the patents and publications referenced therein, are incorporated herein by reference, and the Sections hereafter referred to are Sections of the Research Disclosure.

Except as provided, the silver halide emulsion containing elements employed in this invention can be either negative-working or positive-working as indicated by the type of processing instructions (i.e. color negative, reversal, or direct positive processing) provided with the element. Suitable emulsions and their preparation as well as methods of chemical and spectral sensitization are described in Sections I through V. Various additives such as UV dyes, brighteners, antifoggants, stabilizers, light absorbing and scattering materials, and physical property modifying addenda such as hardeners, coating aids, plasticizers, lubricants and matting agents are described, for example, in Sections II and VI through VIII. Color materials are described in Sections X through XIII. Suitable methods for incorporating couplers and dyes, including dispersions in organic solvents, are described in Section X(E). Scan facilitating is described in Section XIV. Supports, exposure, development systems, and processing methods and agents are described in Sections XV to XX. The information contained in the September 1994 *Research Disclosure,* Item No. 36544 referenced above, is updated in the September 1996 *Research Disclosure,* Item No. 38957. Certain desirable photographic elements and processing steps, including those useful in conjunction with color reflective prints, are described in *Research Disclosure,* Item 37038, February 1995.

Coupling-off groups are well known in the art. Such groups can determine the chemical equivalency of a coupler, i.e., whether it is a 2-equivalent or a 4-equivalent coupler, or modify the reactivity of the coupler. Such groups can advantageously affect the layer in which the coupler is coated, or other layers in the photographic recording material, by performing, after release from the coupler, functions such as dye formation, dye hue adjustment, development acceleration or inhibition, bleach acceleration or inhibition, electron transfer facilitation, color correction and the like.

The presence of hydrogen at the coupling site provides a 4-equivalent coupler, and the presence of another coupling-off group usually provides a 2-equivalent coupler. Representative classes of such coupling-off groups include, for example, chloro, alkoxy, aryloxy, hetero-oxy, sulfonyloxy, acyloxy, acyl, heterocyclyl, sulfonamido, mercaptotetrazole, benzothiazole, mercaptopropionic acid, phosphonyloxy, arylthio, and arylazo. These coupling-off groups are described in the art, for example, in U.S. Pat. Nos. 2,455,169, 3,227,551, 3,432,521, 3,476,563, 3,617,291, 3,880,661, 4,052,212 and 4,134,766; and in UK. Patents and published application Nos. 1,466,728, 1,531,927, 1,533,039, 2,006,755A and 2,017,704A, the disclosures of which are incorporated herein by reference.

Image dye-forming couplers may be included in the element such as couplers that form cyan dyes upon reaction with oxidized color developing agents which are described in such representative patents and publications as: "Farbkuppler-eine Literature Ubersicht," published in Agfa Mitteilungen, Band III, pp. 156–175 (1961) as well as in U.S. Pat. Nos. 2,367,531; 2,423,730; 2,474,293; 2,772,162; 2,895,826; 3,002,836; 3,034,892; 3,041,236; 4,333,999; 4,746,602; 4,753,871; 4,770,988; 4,775,616; 4,818,667; 4,818,672; 4,822,729; 4,839,267; 4,840,883; 4,849,328; 4,865,961; 4,873,183; 4,883,746; 4,900,656; 4,904,575; 4,916,051; 4,921,783; 4,923,791; 4,950,585; 4,971,898; 4,990,436; 4,996,139; 5,008,180; 5,015,565; 5,011,765; 5,011,766; 5,017,467; 5,045,442; 5,051,347; 5,061,613; 5,071,737; 5,075,207; 5,091,297; 5,094,938; 5,104,783; 5,178,993; 5,813,729; 5,187,057; 5,192,651; 5,200,305 5,202,224; 5,206,130; 5,208,141; 5,210,011; 5,215,871; 5,223,386; 5,227,287; 5,256,526; 5,258,270; 5,272,051;

5,306,610; 5,326,682; 5,366,856; 5,378,596; 5,380,638; 5,382,502; 5,384,236; 5,397,691; 5,415,990; 5,434,034; 5,441,863; EPO 0 246 616; EPO 0 250 201; EPO 0 271 323; EPO 0 295 632; EPO 0 307 927; EPO 0 333 185; EPO 0 378 898; EPO 0 389 817; EPO 0 487 111; EPO 0 488 248; EPO 0 539 034; EPO 0 545 300; EPO 0 556 700; EPO 0 556 777; EPO 0 556 858; EPO 0 569 979; EPO 0 608 133; EPO 0 636 936; EPO 0 651 286; EPO 0 690 344; German OLS 4,026,903; German OLS 3,624,777 and German OLS 3,823, 049. Typically such couplers are phenols, naphthols, or pyrazoloazoles.

Couplers that form magenta dyes upon reaction with oxidized color developing agent are described in such representative patents and publications as: "Farbkuppler-eine Literature Ubersicht," published in Agfa Mitteilungen, Band III, pp. 126–156 (1961) as well as U.S. Pat. Nos. 2,311,082 and 2,369,489; 2,343,701; 2,600,788; 2,908,573; 3,062,653; 3,152,896; 3,519,429; 3,758,309; 3,935,015; 4,540,654; 4,745,052; 4,762,775; 4,791,052; 4,812,576; 4,835,094; 4,840,877; 4,845,022; 4,853,319; 4,868,099; 4,865,960; 4,871,652; 4,876,182; 4,892,805; 4,900,657; 4,910,124; 4,914,013; 4,921,968; 4,929,540; 4,933,465; 4,942,116; 4,942,117; 4,942,118; U.S. Pat. Nos. 4,959,480; 4,968,594; 4,988,614; 4,992,361; 5,002,864; 5,021,325; 5,066,575; 5,068,171; 5,071,739; 5,100,772; 5,110,942; 5,116,990; 5,118,812; 5,134,059; 5,155,016; 5,183,728; 5,234,805; 5,235,058; 5,250,400; 5,254,446; 5,262,292; 5,300,407; 5,302,496; 5,336,593; 5,350,667; 5,395,968; 5,354,826; 5,358,829; 5,368,998; 5,378,587; 5,409,808; 5,411,841; 5,418,123; 5,424,179; EPO 0 257 854; EPO 0 284 240; EPO 0 341 204; EPO 347,235; EPO 365,252; EPO 0 422 595; EPO 0 428 899; EPO 0 428 902; EPO 0 459 331; EPO 0 467 327; EPO 0 476 949; EPO 0 487 081; EPO 0 489 333; EPO 0 512 304; EPO 0 515 128; EPO 0 534 703; EPO 0 554 778; EPO 0 558 145; EPO 0 571 959; EPO 0 583 832; EPO 0 583 834; EPO 0 584 793; EPO 0 602 748; EPO 0 602 749; EPO 0 605 918; EPO 0 622 672; EPO 0 622 673; EPO 0 629 912; EPO 0 646 841, EPO 0 656 561; EPO 0 660 177; EPO 0 686 872; WO 90/10253; WO 92/09010; WO 92/10788; WO 92/12464; WO 93/01523; WO 93/02392; WO 93/02393; WO 93/07534; UK Application 2,244,053; Japanese Application 03192-350; German OLS 3,624,103; German OLS 3,912,265; and German OLS 40 08 067. Typically such couplers are pyrazolones, pyrazoloazoles, or pyrazolobenzimidazoles that form magenta dyes upon reaction with oxidized color developing agents.

Couplers that form yellow dyes upon reaction with oxidized color developing agent are described in such representative patents and publications as: "Farbkuppler-eine Literature Ubersicht," published in Agfa Mitteilungen; Band III; pp. 112–126 (1961); as well as U.S. Pat. Nos. 2,298,443; 2,407,210; 2,875,057; 3,048,194; 3,265,506; 3,447,928; 4,022,620; 4,443,536; 4,758,501; 4,791,050; 4,824,771; 4,824,773; 4,855,222; 4,978,605; 4,992,360; 4,994,361; 5,021,333; 5,053,325; 5,066,574; 5,066,576; 5,100,773; 5,118,599; 5,143,823; 5,187,055; 5,190,848; 5,213,958; 5,215,877; 5,215,878; 5,217,857; 5,219,716; 5,238,803; 5,283,166; 5,294,531; 5,306,609; 5,328,818; 5,336,591; 5,338,654; 5,358,835; 5,358,838; 5,360,713; 5,362,617; 5,382,506; 5,389,504; 5,399,474; 5,405,737; 5,411,848; 5,427,898; EPO 0 327 976; EPO 0 296 793; EPO 0 365 282; EPO 0 379 309; EPO 0 415 375; EPO 0 437 818; EPO 0 447 969; EPO 0 542 463; EPO 0 568 037; EPO 0 568 196; EPO 0 568 777; EPO 0 570 006; EPO 0 573 761; EPO 0 608 956; EPO 0 608 957; and EPO 0 628 865. Such couplers are typically open chain ketomethylene compounds.

Couplers that form colorless products upon reaction with oxidized color developing agent are described in such representative patents as: UK. 861,138; U.S. Pat. Nos. 3,632, 345; 3,928,041; 3,958,993 and 3,961,959. Typically such couplers are cyclic carbonyl containing compounds that form colorless products on reaction with an oxidized color developing agent.

Couplers that form black dyes upon reaction with oxidized color developing agent are described in such representative patents as U.S. Pat. Nos. 1,939,231; 2,181,944; 2,333,106; and 4,126,461; German OLS No. 2,644,194 and German OLS No. 2,650,764. Typically, such couplers are resorcinols or m-aminophenols that form black or neutral products on reaction with oxidized color developing agent.

In addition to the foregoing, so-called "universal" or "washout" couplers may be employed. These couplers do not contribute to image dye-formation. Thus, for example, a naphthol having an unsubstituted carbamoyl or one substituted with a low molecular weight substituent at the 2- or 3-position may be employed. Couplers of this type are described, for example, in U.S. Pat. Nos. 5,026,628, 5,151, 343, and 5,234,800.

It may be useful to use a combination of couplers any of which may contain known ballasts or coupling-off groups such as those described in U.S. Pat. No. 4,301,235; U.S. Pat. No. 4,853,319 and U.S. Pat. No. 4,351,897. The coupler may contain solubilizing groups such as described in U.S. Pat. No. 4,482,629. The coupler may also be used in association with "wrong" colored couplers (e.g. to adjust levels of interlayer correction) and, in color negative applications, with masking couplers such as those described in EP 213.490; Japanese Published Application 58-172,647; U.S. Pat. Nos. 2,983,608; 4,070,191; and 4,273,861; German Applications DE 2,706,117 and DE 2,643,965; UK. Patent 1,530,272; and Japanese Application 58-113935. The masking couplers may be shifted or blocked, if desired.

Typically, couplers are incorporated in a silver halide emulsion layer in a mole ratio to silver of 0.05 to 1.0 and generally 0.1 to 0.5. Usually the couplers are dispersed in a high-boiling organic solvent in a weight ratio of solvent to coupler of 0.1 to 10.0 and typically 0.1 to 2.0 although dispersions using no permanent coupler solvent are sometimes employed.

The invention materials may be used in association with materials that release Photographically Useful Groups (PUGS) that accelerate or otherwise modify the processing steps e.g. of bleaching or fixing to improve the quality of the image. Bleach accelerator releasing couplers such as those described in EP 193,389; EP 301,477; U.S. Pat. No. 4,163, 669; U.S. Pat. No. 4,865,956; and U.S. Pat. No. 4,923,784, may be useful. Also contemplated is use of the compositions in association with nucleating agents, development accelerators or their precursors (UK Patent 2,097,140; UK. Patent 2,131,188); electron transfer agents (U.S. Pat. No. 4,859, 578; U.S. Pat. No. 4,912,025); antifogging and anti color-mixing agents such as derivatives of hydroquinones, aminophenols, amines, gallic acid; catechol; ascorbic acid; hydrazides; sulfonamidophenols; and non color-forming couplers.

The invention materials may also be used in combination with filter dye layers comprising colloidal silver sol or yellow, cyan, and/or magenta filter dyes, either as oil-in-water dispersions, latex dispersions or as solid particle dispersions. Additionally, they may be used with "smearing" couplers (e.g. as described in U.S. Pat. No. 4,366,237; EP 96,570; U.S. Pat. No. 4,420,556; and U.S. Pat. No. 4,543,323.) Also, the compositions may be blocked or coated in protected form as described, for example, in Japanese Application 61/258,249 or U.S. Pat. No. 5,019,492.

The invention materials may further be used in combination with image-modifying compounds that release PUGS such as "Developer Inhibitor-Releasing" compounds (DIR's). DIR's useful in conjunction with the compositions of the invention are known in the art and examples are described in U.S. Pat. Nos. 3,137,578; 3,148,022; 3,148,062; 3,227,554; 3,384,657; 3,379,529; 3,615,506; 3,617,291; 3,620,746; 3,701,783; 3,733,201; 4,049,455; 4,095,984; 4,126,459; 4,149,886; 4,150,228; 4,211,562; 4,248,962; 4,259,437; 4,362,878; 4,409,323; 4,477,563; 4,782,012; 4,962,018; 4,500,634; 4,579,816; 4,607,004; 4,618,571; 4,678,739; 4,746,600; 4,746,601; 4,791,049; 4,857,447; 4,865,959; 4,880,342; 4,886,736; 4,937,179; 4,946,767; 4,948,716; 4,952,485; 4,956,269; 4,959,299; 4,966,835; 4,985,336 as well as in patent publications GB 1,560,240; GB 2,007,662; GB 2,032,914; GB 2,099,167; DE 2,842,063, DE 2,937,127; DE 3,636,824; DE 3,644,416 as well as the following European Patent Publications: 272,573; 335,319; 336,411; 346, 899; 362, 870; 365,252; 365,346; 373,382; 376,212; 377,463; 378,236; 384,670; 396,486; 401,612; 401,613.

Such compounds are also disclosed in "Developer-Inhibitor-Releasing (DIR) Couplers for Color Photography," C. R. Barr, J. R. Thirtle and P. W. Vittum in *Photographic Science and Engineering,* Vol. 13, p. 174 (1969), incorporated herein by reference. Generally, the developer inhibitor-releasing (DIR) couplers include a coupler moiety and an inhibitor coupling-off moiety (IN). The inhibitor-releasing couplers may be of the time-delayed type (DIAR couplers) which also include a timing moiety or chemical switch which produces a delayed release of inhibitor. Examples of typical inhibitor moieties are: oxazoles, thiazoles, diazoles, triazoles, oxadiazoles, thiadiazoles, oxathiazoles, thiatriazoles, benzotriazoles, tetrazoles, benzimidazoles, indazoles, isoindazoles, mercaptotetrazoles, selenotetrazoles, mercaptobenzothiazoles, selenobenzothiazoles, mercaptobenzoxazoles, selenobenzoxazoles, mercaptobenzimidazoles, selenobenzimidazoles, benzodiazoles, mercaptooxazoles, mercaptothiadiazoles, mercaptothiazoles, mercaptotriazoles, mercaptooxadiazoles, mercaptodiazoles, mercaptooxathiazoles, telleurotetrazoles or benzisodiazoles. In a preferred embodiment, the inhibitor moiety or group is selected from the following formulas:

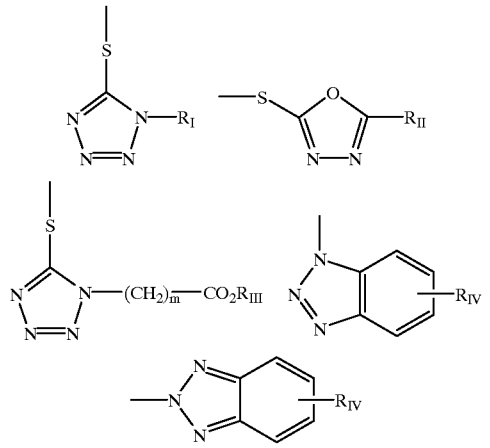

wherein $R_I$ is selected from the group consisting of straight and branched alkyls of from 1 to about 8 carbon atoms, benzyl, phenyl, and alkoxy groups and such groups containing none, one or more than one such substituent; $R_{II}$ is selected from $R_I$ and —$SR_I$; $R_{III}$ is a straight or branched alkyl group of from 1 to about 5 carbon atoms and m is from 1 to 3; and $R_{IV}$ is selected from the group consisting of hydrogen, halogens and alkoxy, phenyl and carbonamido groups, —$COOR_V$ and —$NHCOOR_V$ wherein $R_V$ is selected from substituted and unsubstituted alkyl and aryl groups.

Although it is typical that the coupler moiety included in the developer inhibitor-releasing coupler forms an image dye corresponding to the layer in which it is located, it may also form a different color as one associated with a different film layer. It may also be useful that the coupler moiety included in the developer inhibitor-releasing coupler forms colorless products and/or products that wash out of the photographic material during processing (so-called "universal" couplers).

A compound such as a coupler may release a PUG directly upon reaction of the compound during processing, or indirectly through a timing or linking group. A timing group produces the time-delayed release of the PUG such groups using an intramolecular nucleophilic substitution reaction (U.S. Pat. No. 4,248,962); groups utilizing an electron transfer reaction along a conjugated system (U.S. Pat. Nos. 4,409,323; 4,421,845; 4,861,701, Japanese Applications 57-188035; 58-98728; 58-209736; 58-209738); groups that function as a coupler or reducing agent after the coupler reaction (U.S. Pat. No. 4,438,193; U.S. Pat. No. 4,618,571) and groups that combine the features describe above. It is typical that the timing group is of one of the formulas:

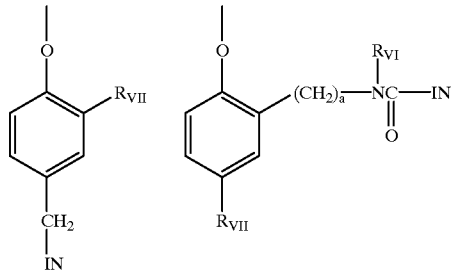

wherein IN is the inhibitor moiety, $R_{VII}$ is selected from the group consisting of nitro, cyano, alkylsulfonyl; sulfamoyl; and sulfonamido groups; a is 0 or 1; and $R_{VI}$ is selected from the group consisting of substituted and unsubstituted alkyl and phenyl groups. The oxygen atom of each timing group is bonded to the coupling-off position of the respective coupler moiety of the DIAR.

The timing or linking groups may also function by electron transfer down an unconjugated chain. Linking groups are known in the art under various names. Often they have been referred to as groups capable of utilizing a hemiacetal or iminoketal cleavage reaction or as groups capable of utilizing a cleavage reaction due to ester hydrolysis such as U.S. Pat. No. 4,546,073. This electron transfer down an unconjugated chain typically results in a relatively fast decomposition and the production of carbon dioxide, formaldehyde, or other low molecular weight by-products. The groups are exemplified in EP 464,612, EP 523,451, U.S. Pat. No. 4,146,396, Japanese Kokai 60-249148 and 60-249149.

Suitable developer inhibitor-releasing couplers for use in the present invention include, but are not limited to, the following:

D1

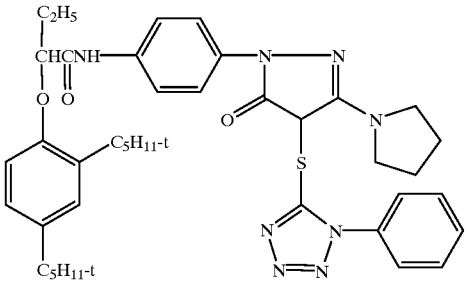

D2

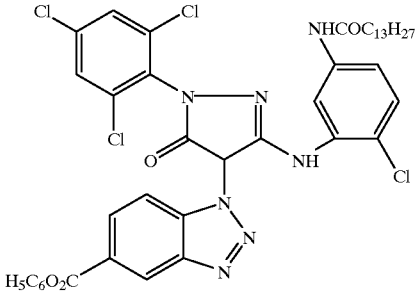

-continued

D3

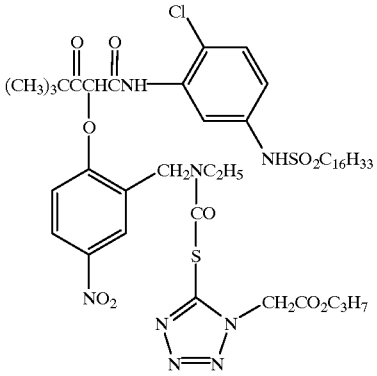

D4

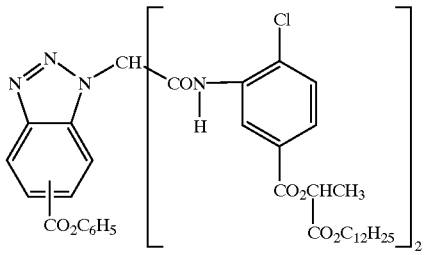

D5

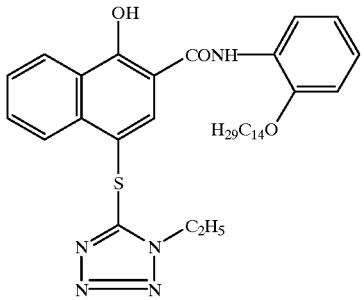

D6

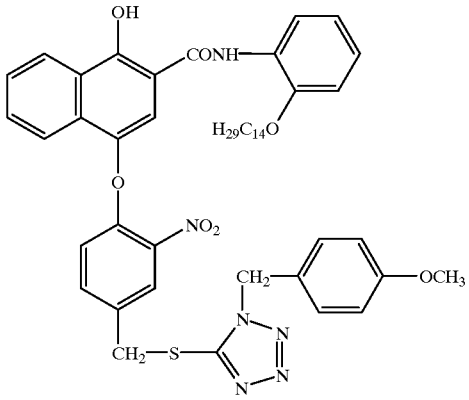

-continued
D7
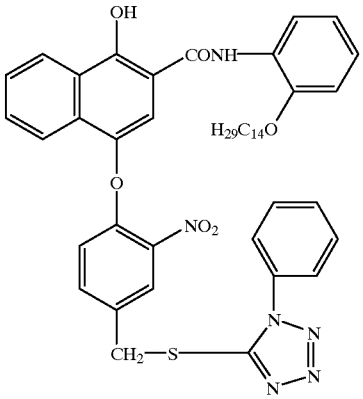
D8
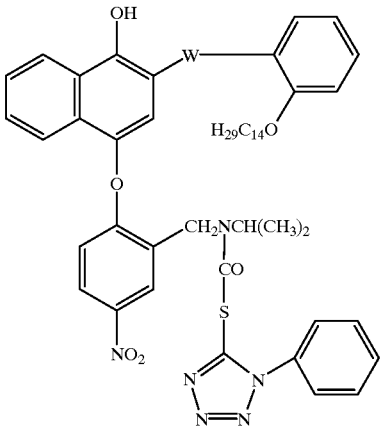
D9
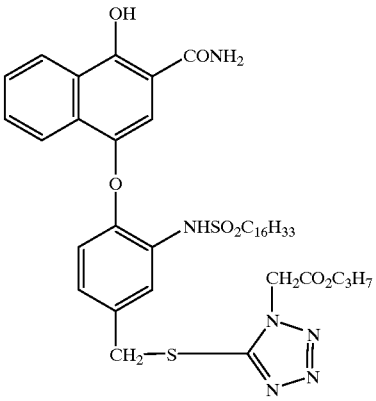
-continued
D10
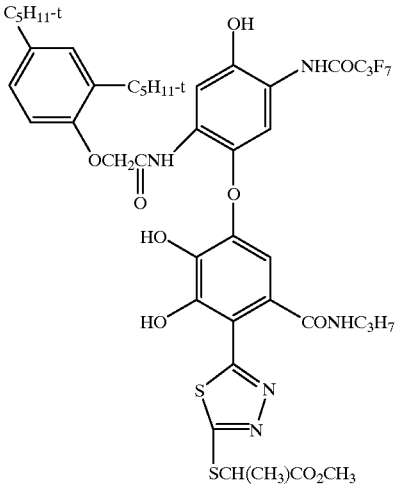
D11
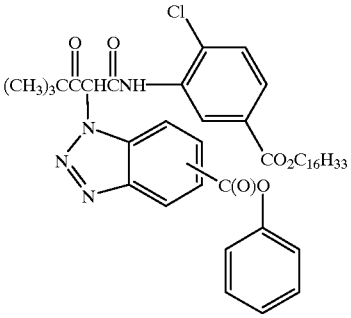
D12
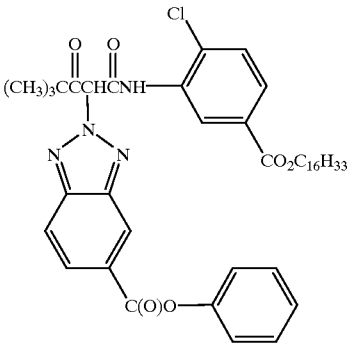
It is also contemplated that the concepts of the present invention may be employed to obtain reflection color prints as described in *Research Disclosure,* November 1979, Item 18716, available from Kenneth Mason Publications, Ltd, Dudley Annex, 12a North Street, Emsworth, Hampshire P0101 7DQ, England, incorporated herein by reference. Materials of the invention may be coated on pH adjusted support as described in U.S. Pat. No. 4,917,994; on a support with reduced oxygen permeability (EP 553,339); with epoxy solvents (EP 164,961); with nickel complex stabilizers (U.S. Pat. No. 4,346,165; U.S. Pat. No. 4,540,653 and U.S. Pat. No. 4,906,559 for example); with ballasted chelating agents such as those in U.S. Pat. No. 4,994,359 to reduce sensitivity to polyvalent cations such as calcium; and with stain reducing compounds such as described in U.S. Pat. No. 5,068,171. Other compounds useful in combination with the invention are disclosed in Japanese Published Applications described in Derwent Abstracts having accession numbers as follows: 90-072,629, 90-072,630; 90-072,631; 90-072,632; 90-072, 633; 90-072,634; 90-077,822; 90-078,229; 90-078,230; 90-079,336; 90-079,337; 90-079,338; 90-079,690; 90-079, 691; 90-080,487; 90-080,488; 90-080,489; 90-080,490; 90-080,491; 90-080,492; 90-080,494; 90-085,928; 90-086, 669; 90-086,670; 90-087,360; 90-087,361; 90-087,362; 90-087,363; 90-087,364; 90-088,097; 90-093,662; 90-093, 663; 90-093,664; 90-093,665; 90-093,666; 90-093,668; 90-094,055; 90-094,056; 90-103,409; 83-62,586; 83-09, 959.

Conventional radiation-sensitive silver halide emulsions can be employed in the practice of this invention. Such emulsions are illustrated by *Research Disclosure,* Item 38755, September 1996, I. Emulsion grains and their preparation.

Especially useful in this invention are tabular grain silver halide emulsions. Tabular grains are those having two parallel major crystal faces and having an aspect ratio of at least 2. The term "aspect ratio" is the ratio of the equivalent circular diameter (ECD) of a grain major face divided by its thickness (t). Tabular grain emulsions are those in which the tabular grains account for at least 50 percent (preferably at least 70 percent and optimally at least 90 percent) of the total grain projected area. Preferred tabular grain emulsions are those in which the average thickness of the tabular grains is less than 0.3 micrometer (preferably thin—that is, less than 0.2 micrometer and most preferably ultrathin—that is, less than 0.07 micrometer). The major faces of the tabular grains can lie in either {111} or {100} crystal planes. The mean ECD of tabular grain emulsions rarely exceeds 10 micrometers and more typically is less than 5 micrometers.

In their most widely used form tabular grain emulsions are high bromide {111} tabular grain emulsions. Such emulsions are illustrated by Kofron et al U.S. Pat. No. 4,439,520, Wilgus et al U.S. Pat. No. 4,434,226, Solberg et al U.S. Pat. No. 4,433,048, Maskasky U.S. Pat. Nos. 4,435, 501, 4,463,087 and 4,173,320, Daubendiek et al U.S. Pat. Nos. 4,414,310 and 4,914,014, Sowinski et al U.S. Pat. No. 4,656,122, Piggin et al U.S. Pat. Nos. 5,061,616 and 5,061, 609, Tsaur et al U.S. Pat. Nos. 5,147,771, '772, '773, 5,171,659 and 5,252,453, Black et al U.S. Pat. Nos. 5,219, 720 and 5,334,495, Delton U.S. Pat. Nos. 5,310,644, 5,372, 927 and 5,460,934, Wen U.S. Pat. No. 5,470,698, Fenton et al U.S. Pat. No. 5,476,760, Eshelman et al U.S. Pat. Nos. 5,612,175 and 5,614,359, and Irving et al U.S. Pat. No. 5,667,954.

Ultrathin high bromide {111} tabular grain emulsions are illustrated by Daubendiek et al U.S. Pat. Nos. 4,672,027, 4,693,964, 5,494,789, 5,503,971 and 5,576,168, Antoniades et al U.S. Pat. No. 5,250,403, Olm et al U.S. Pat. No. 5,503,970, Deaton et al U.S. Pat. No. 5,582,965, and Maskasky U.S. Pat. No. 5,667,955.

High bromide {100} tabular grain emulsions are illustrated by Mignot U.S. Pat. Nos. 4,386,156 and 5,386,156.

High chloride {111} tabular grain emulsions are illustrated by Wey U.S. Pat. No. 4,399,215, Wey et al U.S. Pat. No. 4,414,306, Maskasky U.S. Pat. Nos. 4,400,463, 4,713, 323, 5,061,617, 5,178,997, 5,183,732, 5,185,239, 5,399,478 and 5,411,852, and Maskasky et al U.S. Pat. Nos. 5,176,992 and 5,178,998. Ultrathin high chloride {111} tabular grain emulsions are illustrated by Maskasky U.S. Pat. Nos. 5,271, 858 and 5,389,509.

High chloride {100} tabular grain emulsions are illustrated by Maskasky U.S. Pat. Nos. 5,264,337, 5,292,632, 5,275,930 and 5,399,477, House et al U.S. Pat. No. 5,320, 938, Brust et al U.S. Pat. No. 5,314,798, Szajewski et al U.S. Pat. No. 5,356,764, Chang et al U.S. Pat. Nos. 5,413,904 and 5,663,041, Oyamada U.S. Pat. No. 5,593,821, Yamashita et al U.S. Pat. Nos. 5,641,620 and 5,652,088, Saitou et al U.S. Pat. No. 5,652,089, and Oyamada et al U.S. Pat. No. 5,665,530. Ultrathin high chloride {100} tabular grain emulsions can be prepared by nucleation in the presence of iodide, following the teaching of House et al and Chang et al, cited above.

The emulsions can be surface-sensitive emulsions, i.e., emulsions that form latent images primarily on the surfaces of the silver halide grains, or the emulsions can form internal latent images predominantly in the interior of the silver halide grains. The emulsions can be negative-working emulsions, such as surface-sensitive emulsions or unfogged internal latent image-forming emulsions, or direct-positive emulsions of the unfogged, internal latent image-forming type, which are positive-working when development is conducted with uniform light exposure or in the presence of a nucleating agent. Tabular grain emulsions of the latter type are illustrated by Evans et al. U.S. Pat. No. 4,504,570.

Photographic elements can be exposed to actinic radiation, typically in the visible region of the spectrum, to form a latent image and can then be processed to form a visible dye image. Processing to form a visible dye image includes the step of contacting the element with a color developing agent to reduce developable silver halide and oxidize the color developing agent. Oxidized color developing agent in turn reacts with the coupler to yield a dye. If desired "Redox Amplification" as described in Research Disclosure XVIIB(5) may be used.

With negative-working silver halide, the processing step described above provides a negative image. One type of such element, referred to as a color negative film, is designed for image capture. Speed (the sensitivity of the element to low light conditions) is usually critical to obtaining sufficient image in such elements. Such elements are typically silver bromoiodide emulsions coated on a transparent support and may be processed, for example, in known color negative processes such as the Kodak C-41 process as described in The British Journal of Photography Annual of 1988, pages 191–198. If a color negative film element is to be subsequently employed to generate a viewable projection print as for a motion picture, a process such as the Kodak ECN-2 process described in the H-24 Manual available from Eastman Kodak Co. may be employed to provide the color negative image on a transparent support. Color negative development times are typically 3' 15" or less and desirably 90 or even 60 seconds or less.

The photographic element of the invention can be incorporated into exposure structures intended for repeated use or exposure structures intended for limited use, variously referred to by names such as "single use cameras", "lens with film", or "photosensitive material package units".

Another type of color negative element is a color print. Such an element is designed to receive an image optically printed from an image capture color negative element. A color print element may be provided on a reflective support for reflective viewing (e.g. a snap shot) or on a transparent support for projection viewing as in a motion picture. Elements destined for color reflection prints are provided on a reflective support, typically paper, employ silver chloride emulsions, and may be optically printed using the so-called negative-positive process where the element is exposed to light through a color negative film which has been processed as described above. The element is sold with instructions to process using a color negative optical printing process, for example the Kodak RA-4 process, as generally described in PCT WO 87/04534 or U.S. Pat. No. 4,975,357, to form a positive image. Color projection prints may be processed, for example, in accordance with the Kodak ECP-2 process as described in the H-24 Manual. Color print development times are typically 90 seconds or less and desirably 45 or even 30 seconds or less.

A reversal element is capable of forming a positive image without optical printing. To provide a positive (or reversal) image, the color development step is preceded by development with a non-chromogenic developing agent to develop exposed silver halide, but not form dye, and followed by uniformly fogging the element to render unexposed silver halide developable. Such reversal emulsions are typically sold with instructions to process using a color reversal process such as the Kodak E-6 process as described in The British Journal of Photography Annual of 1988, page 194. Alternatively, a direct positive emulsion can be employed to obtain a positive image.

The above elements are typically sold with instructions to process using the appropriate method such as the mentioned color negative (Kodak C-41), color print (Kodak RA-4), or reversal (Kodak E-6) process.

Preferred color developing agents are p-phenylenediamines such as:

4-amino-N,N-diethylaniline hydrochloride, 4-amino-3-methyl-N,N-diethylaniline hydrochloride, 4-amino-3-methyl-N-ethyl-N-(2-methanesulfonamidoethyl) aniline sesquisulfate hydrate, 4-amino-3-methyl-N-ethyl-N-(2-hydroxyethyl)aniline sulfate, 4-amino-3-(2-methanesulfonamidoethyl)-N,N-diethylaniline hydrochloride, and 4-amino-N-ethyl-N-(2-methoxyethyl)-m-toluidine di-p-toluene sulfonic acid.

Development is usually followed by the conventional steps of bleaching, fixing, or bleach-fixing, to remove silver or silver halide, washing, and drying.

The entire contents of the patents and other publications referred to in this specification are incorporated herein by reference.

Following is a list of specific representative examples of cyan dye-forming couplers in accordance with the present invention:

C-1

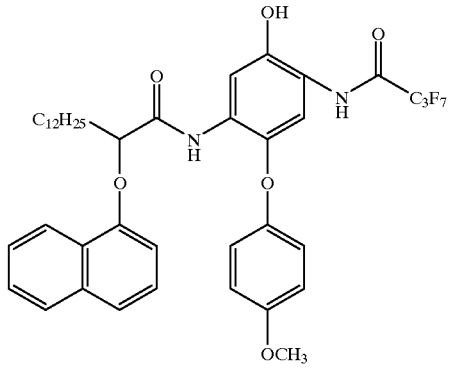

C-2

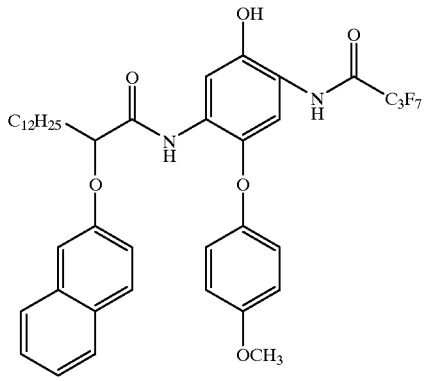

C-3

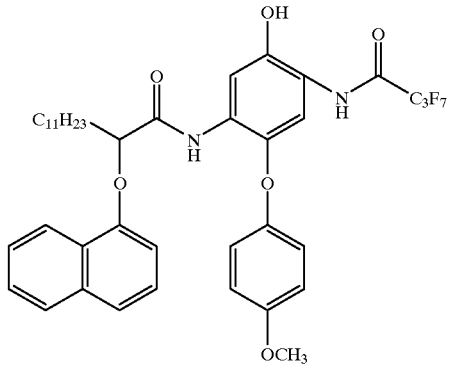

-continued
C-4
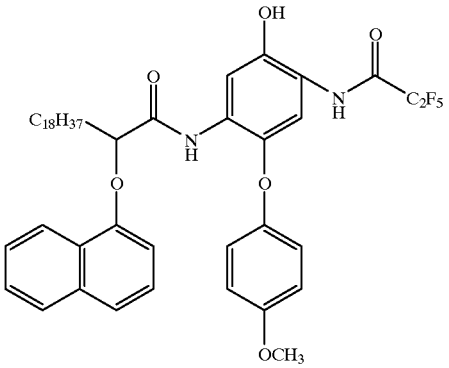
C-5
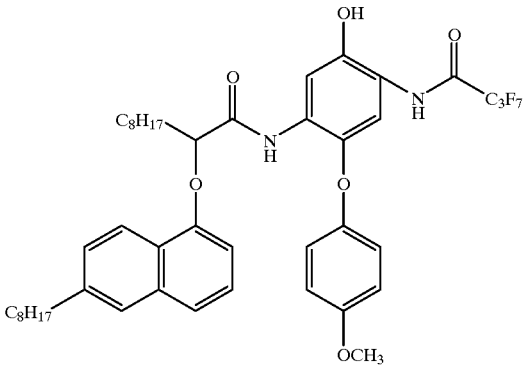
C-6
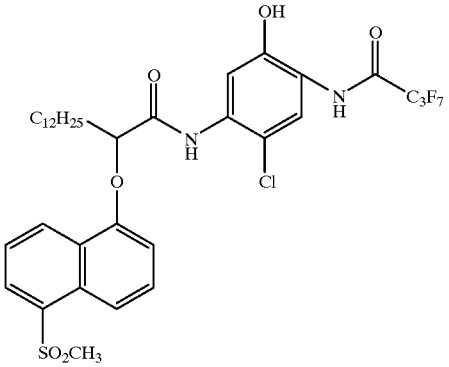
C-7
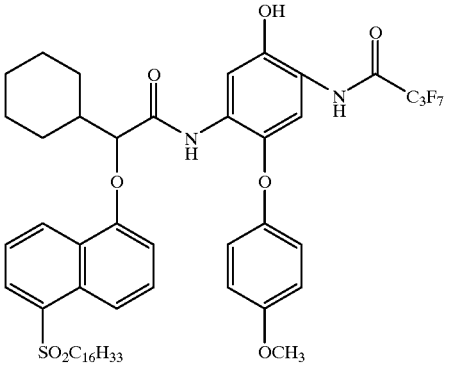
-continued
C-8
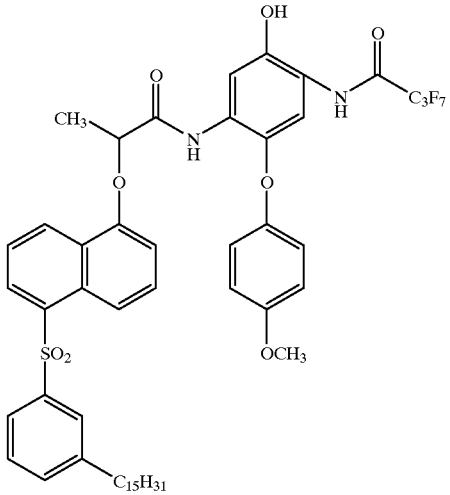
C-9
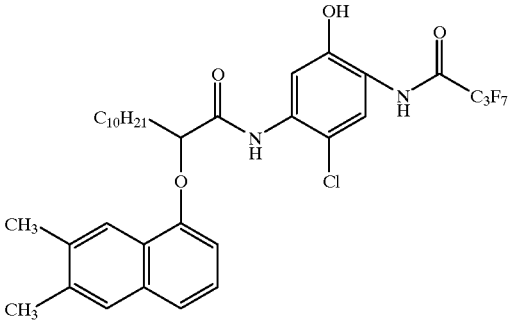
C-10
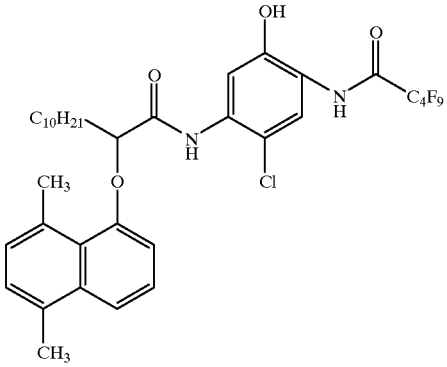
C-11
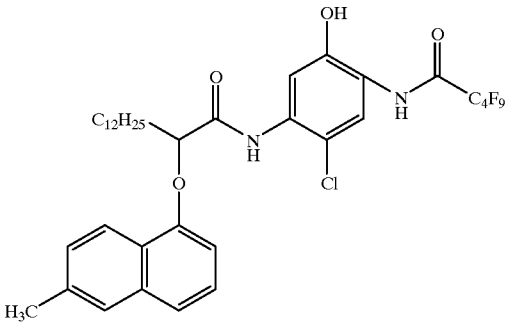

-continued
C-12
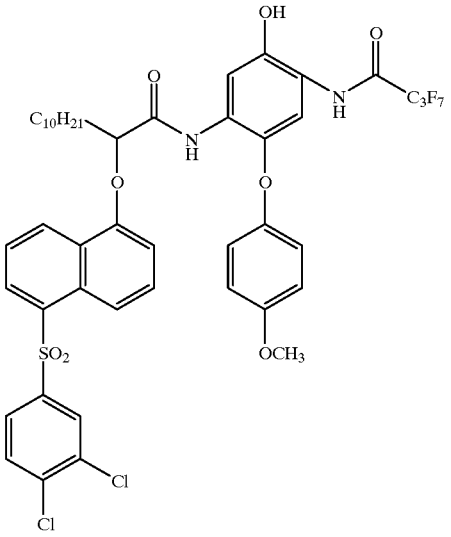
C-13
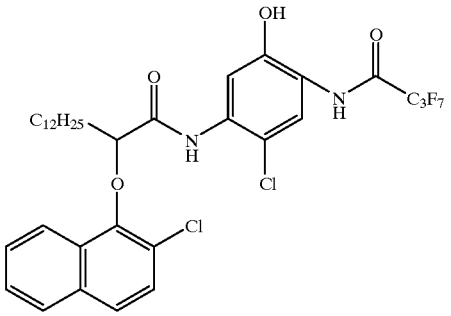
C-14
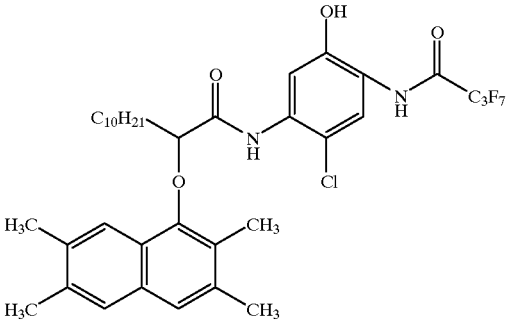
C-15
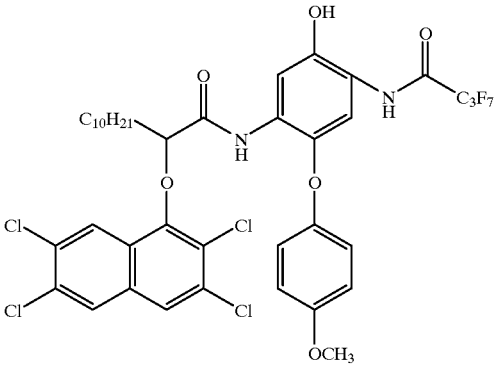
-continued
C-16
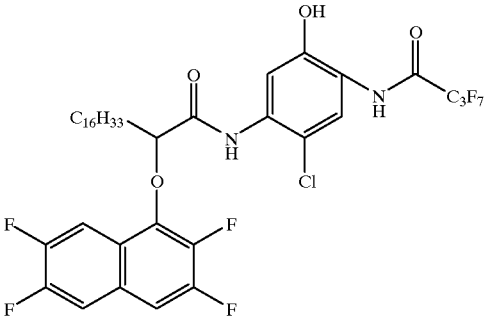
C-17
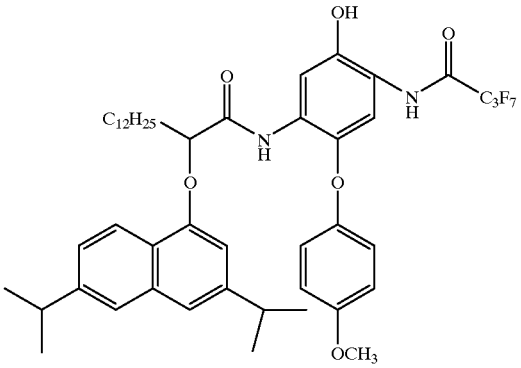
C-18
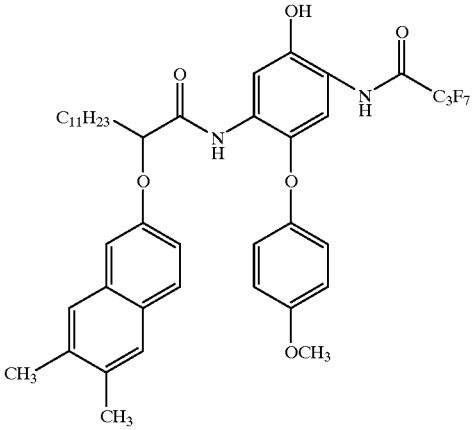

-continued
C-19
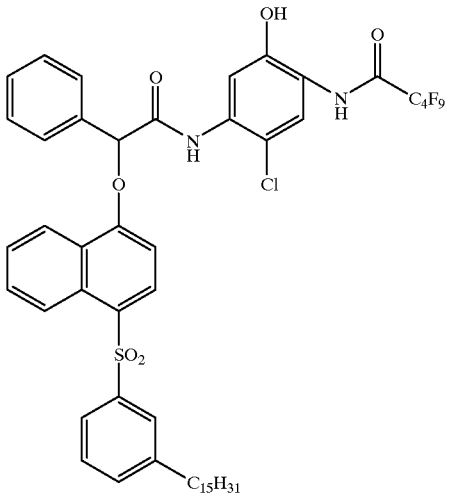
C-20
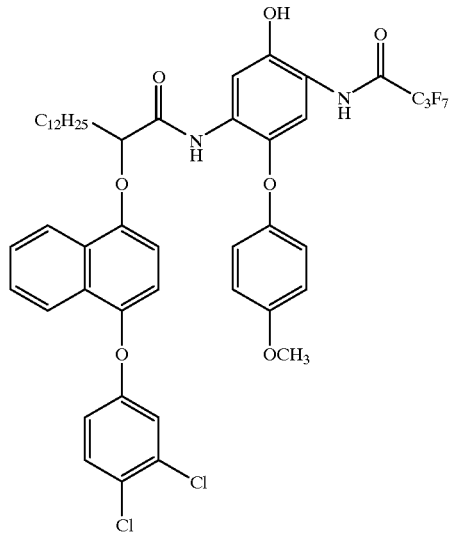
C-21
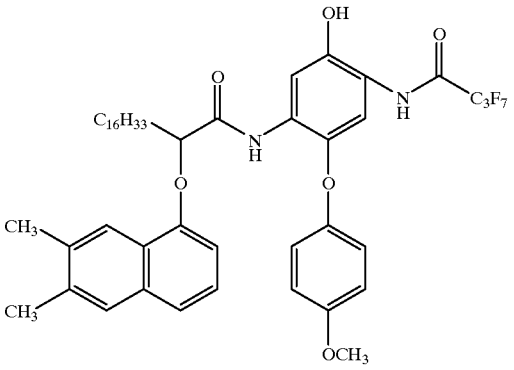
-continued
C-22
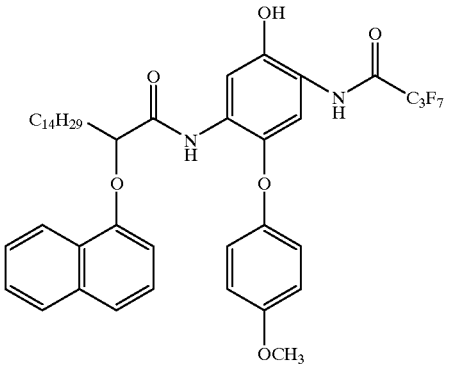
The cyan dye-forming couplers of the present invention can be prepared according to the following general synthetic scheme:
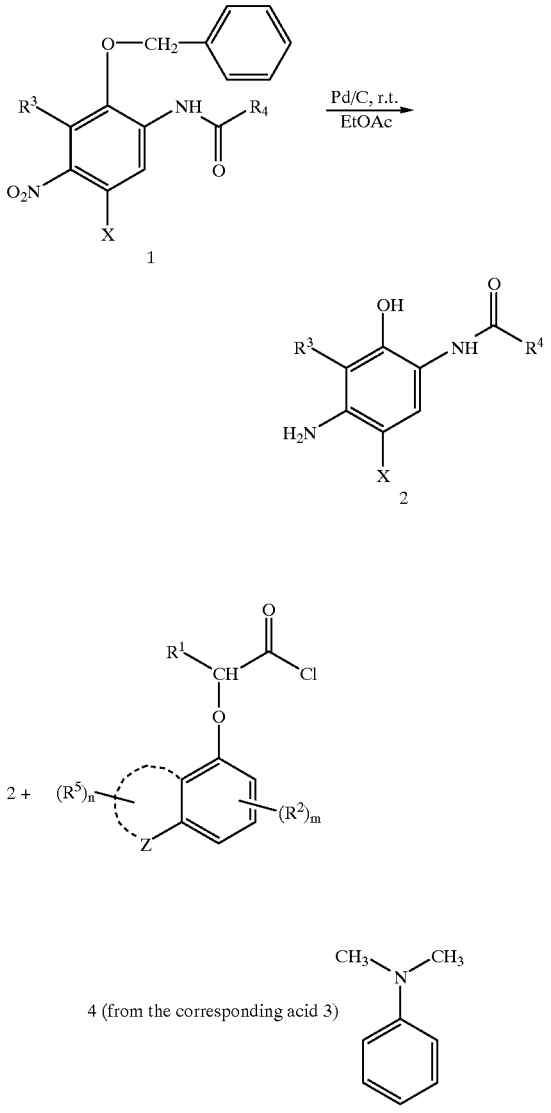

-continued

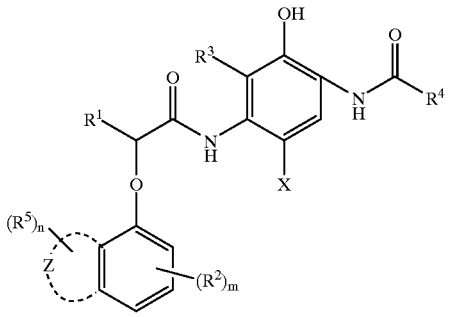

Coupler C-1 of the invention was prepared by the following scheme and procedure:

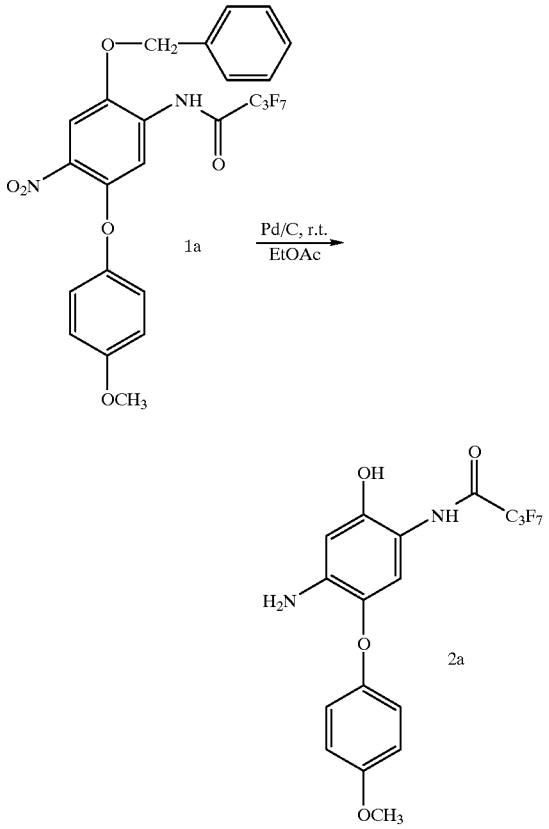

-continued

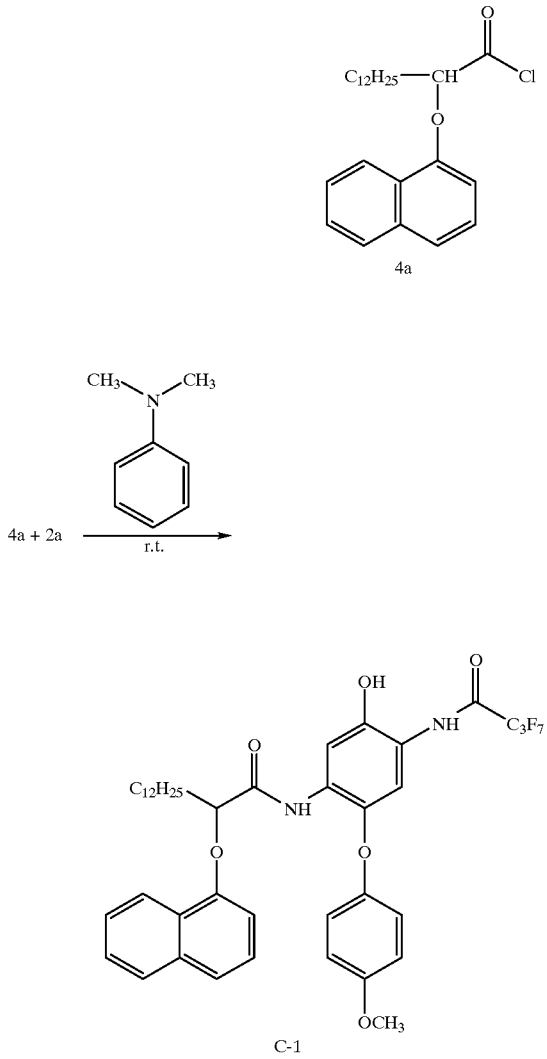

a) $N^1$-[4-amino-2-hydroxy-5-(4-methoxyphenoxy) phenyl]-2,2,3,3,4,4,4-heptafluorobutanimide (2a)

To a solution of 5.63 g (10 mmol) of $N^1$-[2-(benzyloxy)-5-(4-methoxyphenoxy)-4-nitrophenyl]-2,2,3,3,4,4,4-heptafluorobutanimide in about 25 mL of ethyl acetate was added a catalytic amount of Pd/C (10%). The nitro compound was reduced and the benzyl group removed by hydrogen at an initial pressure of 40 psi at room temperature for 12 hr, after which TLC (EtOAc/ligroin: 2/1) indicated reaction was complete. Intermediate (2a) was used in the next step in the same hydrogenation vessel.

b) $N^1$-[4-[(2,2,3,3,4,4,4-heptafluorobutanoyl)amino]-5-hydroxy-2-(4-methoxy phenoxy]-2-(naphth-1-oxy) tetradecanamide. (Coupler C-1)

To the above reaction vessel was added 1.34 g (11 mmol) of N,N-dimethylaniline, followed by the addition of a tetrahydrofuran (THF) solution of acid chloride (4a) prepared from 3.89 g (10.5 mmole) of 2-(1-naphthoxy)tetradecanoic acid (3a). After the addition had been completed, the mixture was stirred for 3 hr at room temperature. TLC analysis (EtOAc/ligroin: 2/1) indicated reaction was complete. The mixture was filtered to remove the catalyst, and the filter cake was washed with THF. The combined filtrates were concentrated in vacuo to about 20 mL of residue, which was poured into a mixture of ice-water containing 7 mL of concentrated HCl. The resulting solid was stirred for 1 hr; the supernatant liquid was decanted, and fresh water was added. The mixture was stirred for an additional hour. This procedure was repeated twice. The sandy solid was collected, washed successively with water and cold pentane, and dried in vacuo for 2 days to yield 6.5 g (81.8%) of white solid. LC indicated 97.8% purity. All analytical data confirmed the assigned structure.

The following comparison couplers were used in the evaluation of the couplers of the invention:

CC-1

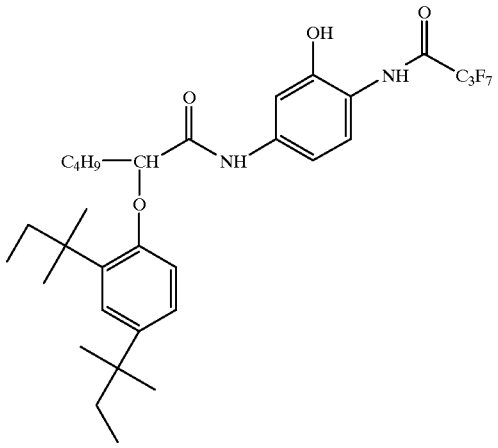

CC-2

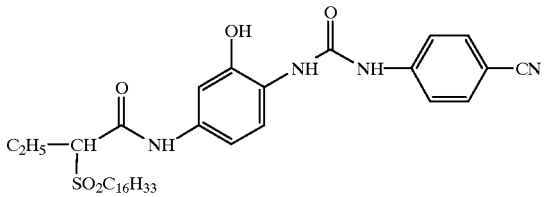

CC-3

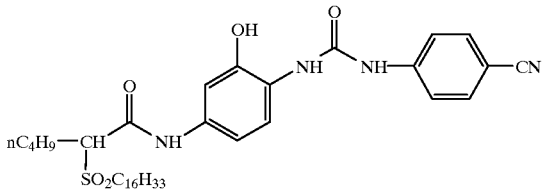

CC-4

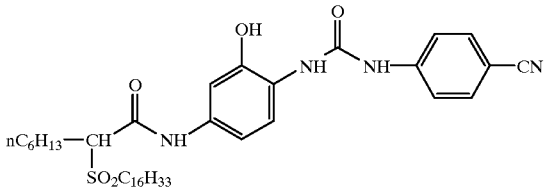

CC-5

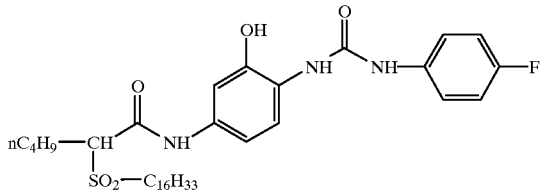

-continued

CC-6

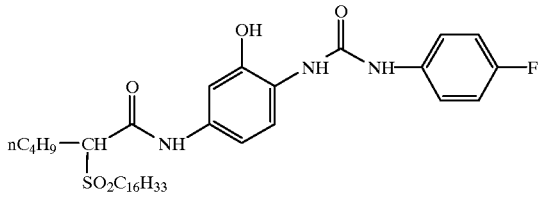

CC-7

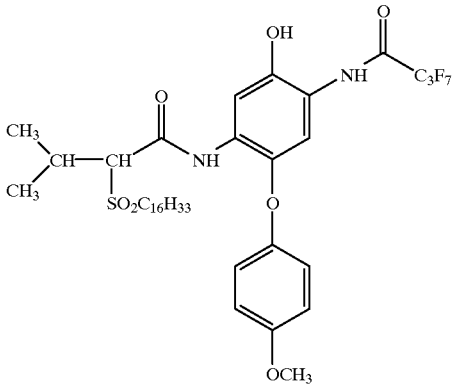

CC-8

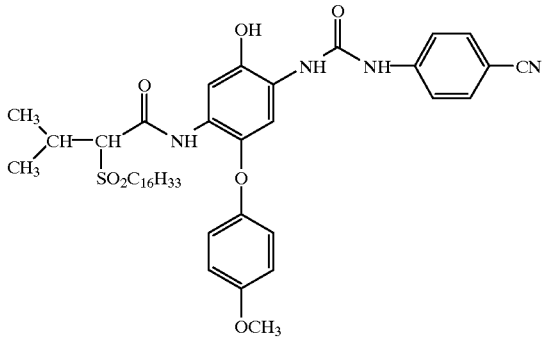

CC-9

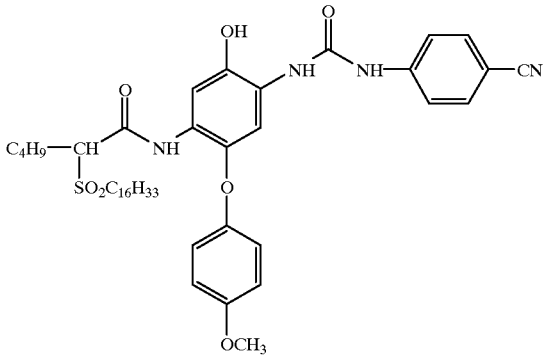

-continued

CC-10

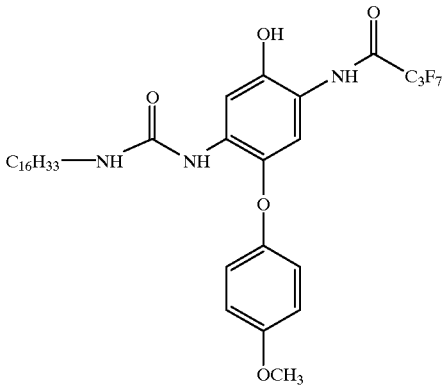

CC-11

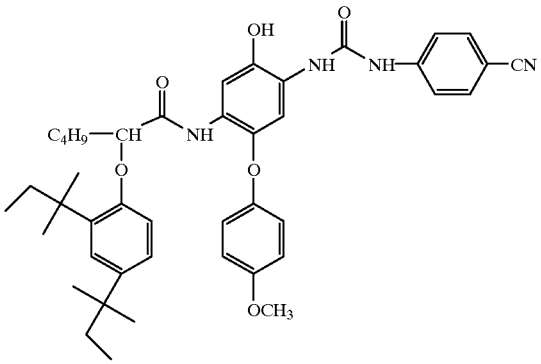

Couplers of the present invention were tested along with comparison couplers. Table I depicts the structural features of the inventive and comparison couplers tested and indicates whether the features are within the limitations of the invention.

TABLE I

| Coupler | Type | Within the Invention? Yes (Y) | No (N) | Comments |
|---|---|---|---|---|
| C-1 | Invention | Yes | Yes | |
| C-2 | Invention | Yes | Yes | |
| CC-1 | Comp. | No | Yes | |
| CC-2 | Comp. | No | No | |
| CC-3 | Comp. | No | No | |
| CC-4 | Comp. | No | No | |
| CC-5 | Comp. | No | Yes | |
| CC-6 | Comp. | No | No | |
| CC-7 | Comp. | No | Yes | |
| CC-8 | Comp. | No | No | |
| CC-9 | Comp. | No | No | |
| CC-10 | Comp. | No | Yes | |
| CC-11 | Comp. | No | No | |

Testing of Photographic Elements

Cyan dyes were formed upon processing of photographic elements prepared as described below. The following photographic characteristics were determined: $D_{max}$ (the maximum density to red light, $D_{min}$ (the minimum density to blue light); speed (the relative log exposure required to yield a density to red light of 1.0); and contrast (the ratio (S−T)/0.6, where S is the density at a log exposure 0.3 units greater than the speed value and T is the density at a log exposure 0.3 units less than the speed value).

Visible reflectance spectra of a set of exposed and processed strips were measured at a dye density that gave an absorbance near 1.0 at the peak maximum. The spectra were measured from 360 nm to 800 nm on a Hitachi 3410 scanning spectrophotometer using a 0/45 reflectance geometry, and $\lambda_{max}$ and bandwidth values were determined.

Preparation of Photographic Elements Having a Reflection Support

Dispersions of the couplers were prepared in the following manner: In one vessel, coupler C-2 (1.086 g, 1.36 mmol), coupler solvent dibutyl phthalate (0.566 g), and ethyl acetate (3.40 g) were combined and warmed to dissolve. In a second vessel, gelatin (2.29 g), Alkanol XC™ (2.29 g, from E.I. duPont Co.), and water (31.7 g) were combined, added to the first vessel, and passed three times through a Gaulin colloid mill. The ethyl acetate was removed by evaporation. The resulting dispersion was mixed with water, and the required amount of a red sensitive AgCl emulsion to produce a coating melt with a gel content of 2.0%. This melt was then coated as the chromogenic layer as described below.

The photographic elements were prepared by coating the following layers in the order listed on a resin-coated paper support:

| | |
|---|---|
| 1st layer | |
| Gelatin | 27.9 mg/m$^2$ |
| 2nd layer | |
| Gelatin | 13.9 mg/m$^2$ |
| Coupler | 0.74E-5 mol/m$^2$ |
| Coupler solvent dibutyl phthalate | equivalent to ½ coupler weight |
| Red-sensitized AgCl emulsion | 3.35 mg Ag/.m$^2$ (4-eq coupler)<br>1.68 mg Ag/m$^2$ (2-eq coupler) |
| 3rd layer | |
| Gelatin | 11.52 mg/m$^2$ |
| 2-(2H-benzotriazol-2-yl)-4,6-bis-(1,1-dimethylpropyl)phenol | 6.32 mg/m$^2$ |
| Tinuvin 326 ™ (Ciba-Geigy) | 1.12 mg/m$^2$ |
| 4th layer | |
| Gelatin | 12.08 mg/m$^2$ |
| Bis(vinylsulfonylmethyl)ether | 1.17 mg/m$^2$ |

Exposure and Negative Processing of Reflection Photographic Elements

The photographic elements prepared on a reflection support as described above were given stepwise exposures to red light and processed as follows at 35° C.:

| | |
|---|---|
| Developer | 45 seconds |
| Bleach-Fix | 45 seconds |
| Wash (running Water) | 1 minute, 30 seconds |

The developer and bleach-fix had the following compositions:

| | |
|---|---|
| Developer | |
| Water | 700.00 mL |
| Triethanolamine | 12.41 g |
| Blankophor REU ™ (Mobay Corp.) | 2.30 g |
| Lithium polystyrene sulfonate (30%) | 0.30 g |
| N,N-Diethylhydroxylamine (85%) | 5.40 g |
| Lithium sulfate | 2.70 g |
| N-{2-[(4-amino-3-methylphenyl) ethylamino]ethyl}methanesulfonamide sesquisulfate | 5.00 g |
| 1-Hydroxyethyl-1,1-diphosphonic acid (60%) | 0.81 g |
| Potassium carbonate, anhydrous | 21.16 g |
| Potassium chloride | 1.60 g |
| Potassium bromide | 7.00 mg |
| Water to make | 1.00 L |
| pH @ 26.7° C. adjusted to 10.4 +/− 0.05 | |
| Bleach-Fix | |
| Water | 700.00 mL |
| Solution of ammonium thiosulfate (54.4%) + ammonium sulfite (4%) | 127.40 g |
| Sodium metabisulfite | 10.00 g |
| Acetic acid (glacial) | 10.20 g |
| Solution of ammonium ferric ethylenediaminetetraacetate (44%) + ethylenediaminetetraacetic acid (3.5%) | 110.40 g |
| Water to make | 1.00 L |
| pH @ 26.7° C. adjusted to 5.5 | |

Photographic Test Results in Color Negative Reflection Format

The test results from exposing and processing the photographic elements containing the reflection support are summarized in Table II below:

TABLE II

| Coupler | Type | $D_{max}$ | Bandwidth | $\lambda_{max}$ (nm) | 8 weeks wet/dark loss at d = 1.0 75° C./50% RH |
|---|---|---|---|---|---|
| C-1 | Inv. | 2.66 | 180 | 656 | −0.10 |
| C-2 | Inv. | 2.77 | 174 | 650 | −0.12 |
| CC-2 | Comp. | 2.58 | 187 | 685 | +0.05 |
| CC-7 | Comp. | 2.64 | 189 | 657 | −0.19 |
| CC-8 | Comp. | 2.64 | 192 | 657 | +0.13 |
| CC-9 | Comp. | 2.48 | 192 | 676 | +0.18 |
| CC-10 | Comp. | 2.29 | 194 | 683 | −0.24 |
| CC-11 | Comp. | 1.89 | 198 | 683 | +0.10 |

Preparation of Color Reversal Photographic Elements

Dispersions of the couplers were prepared in the following manner: In one vessel, coupler C-1 (2.887 g, 3.63 mmol), coupler solvent dibutyl phthalate (0.33 g), and ethyl acetate (3.840 g) were combined and warmed to dissolve. In a second vessel, gelatin (2.887 g), Alkanol XC™ (2.89 g, from E.I. DuPont Co.), and water (35.29 g) were combined, added to the first vessel, and passed three times through a Gaulin colloid mill. The ethyl acetate was removed by evaporation. The resulting dispersion was mixed with water, gelatin, and the required amount of a red-sensitive AgBrI emulsion to provide a coating melt with a gel content of 3.0%. The melt was then coated as the chromogenic layer, as described below.

The color reversal photographic elements were prepared by coating the following layers in the order listed on a cellulose triacetate support:

| | |
|---|---|
| First layer | |
| Gelatin | 323.0 mg/m$^2$ |
| Second layer | |
| Gelatin | 3230 mg/m$^2$ |
| Coupler | 2.692 mmol/m$^2$ |
| Coupler solvent dibutyl phthalate | 244.9 mg/m$^2$ |
| Red-sensitized AgBrI emulsion | 861.3 mg Ag/m$^2$ |
| Third layer | |
| Gelatin | 969.0 mg/m$^2$ |
| Bis(vinylsulfonyl)methane | 85.9 mg/m$^2$ |

Exposure and Processing of Color Reversal Photographic Elements

Each color reversal element was given a 0–3 normal stepwise exposure to light with a color temperature of 2850 degrees K for 0.01 second using a heat-absorbing filter and a 0.6 Inconel neutral density filter. The exposed element was processed using the normal E-6 process except that the first developer time was 3 minutes instead of the customary 6 minutes.

Color Reversal Photographic Test Results

The test results from exposing and processing the color reversal photographic elements are summarized in Table III below:

TABLE III

| Coupler | Type | $D_{max}$ | Band-width | $\lambda_{max}$ (nm) | Change of $D_{max}$ when pH changes from 11.60 to 12.20 (slope) | 6 wks 60° C./70% Loss heat/wet (from d = 1.0) |
|---|---|---|---|---|---|---|
| C-1 | Inv. | 2.84 | 130 | 658 | (−) | −0.10 |
| CC-1 | Comp. | 1.67 | 140 | 656 | (−) | −0.14 |
| CC-2 | Comp. | 2.23 | 132 | 688 | (+) | +0.59 |
| CC-3 | Comp. | 2.71 | 150 | 663 | (+) | +0.27 |
| CC-4 | Comp. | 2.83 | 150 | 672 | (−) | +0.52 |
| CC-5 | Comp. | 2.72 | 152 | 637 | variable | +0.12 |
| CC-6 | Comp. | 2.49 | 158 | 634 | variable | +0.12 |

Analysis of the color paper format data in Table II shows that couplers C-1 and C-2 of the present invention offer the following advantages in photographic properties over the comparison couplers: simultaneously high coupling efficiency, narrow bandwidth (high hue purity), desired hue, and improved cyan image dye heat/wet stability.

Analysis of the color reversal format data in the Table III shows that coupler C-1 of the invention offers the following advantages in photographic properties over the tested comparison cyan couplers: simultaneously high coupling activity, narrow bandwidth (hue purity), desirable hue, and improved image dye heat/wet stability, while maintaining the desired response of $D_{max}$ to pH change.

The invention has been described in detail with particular reference to certain preferred embodiments thereof, but it will be understood that variations and modifications can be effected within the spirit and scope of the invention.

What is claimed is:

1. A color photographic element comprising a support, a silver halide emulsion layer, and associated therewith a phenolic dye-forming coupler having the formula

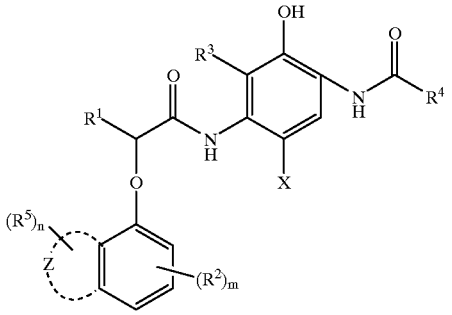

wherein $R^1$ represents hydrogen, a straight or branched chain alkyl group having 1 to about 20 carbon atoms, a cycloalkyl group having about 3 to 8 carbon atoms in the ring, or an aryl group having 6 to about 20 carbon atoms;

$R^2$ represents hydrogen or a substituent;

$R^3$ represents hydrogen, halogen, or alkyl, cycloalkyl or aryl groups as defined for $R^1$;

$R^4$ represents a fluorosubstituted alkyl group having 1 to about 20 carbon atoms, a fluorosubstituted cycloalkyl group having about 3 to 8 carbon atoms, or a fluorosubstituted aryl group having 6 to about 20 carbon atoms;

$R^5$ represents hydrogen or a substituent;

X represents hydrogen or a coupling-off group;

Z represents carbon atoms or hetero atoms necessary to complete a 5-,6-, or 7-membered ring;

m is 0 to 3; and n is 0 to 4.

2. The color photographic element of claim 1 wherein said support comprises a substantially transparent support.

3. The color photographic element of claim 1 wherein said support comprises a reflective support.

4. The color photographic element of claim 1 wherein said silver halide emulsion layer is a red-sensitized emulsion layer.

5. The color photographic element of claim 1 wherein $R^1$ represents an alkyl group having 1 to about 20 carbon atoms.

6. The color photographic element of claim 1 wherein $R^2$ represents hydrogen, halogen, or an alkyl group containing 1 to about 3 carbon atoms.

7. The color photographic element of claim 1 wherein $R^3$ represents hydrogen.

8. The color photographic element of claim 1 wherein $R^4$ represents a fluorosubstituted alkyl group or a fluorosubstituted aryl group.

9. The color photographic element of claim 8 wherein $R^4$ represents a perfluorosubstituted alkyl group containing 1 to about 4 carbon atoms.

10. The color photographic element of claim 1 wherein $R^5$ represents hydrogen, an alkylsulfonyl group, or an arylsulfonyl group.

11. The color photographic element of claim 1 wherein X represents hydrogen, halogen, or an aryloxy group.

12. The color photographic element of claim 11 wherein X represents chlorine or a p-methoxyphenoxy group.

13. The color photographic element of claim 1 wherein Z represents 4 carbon atoms that complete a fused 6-membered aryl ring.

14. The color photographic element of claim 1 wherein m and n are each independently 0 or 1.

15. The color photographic element of claim 1 wherein said phenolic dye-forming coupler is selected from the group consisting of

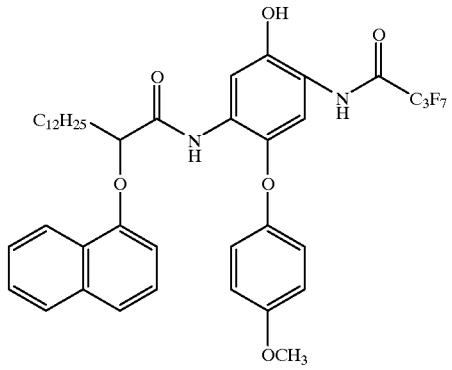

-continued
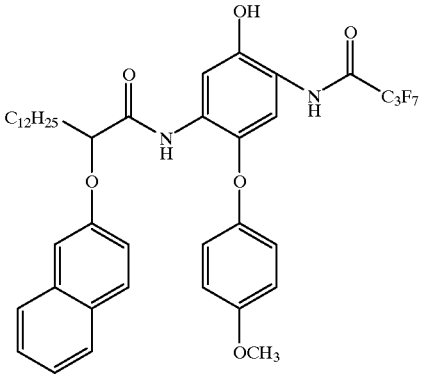
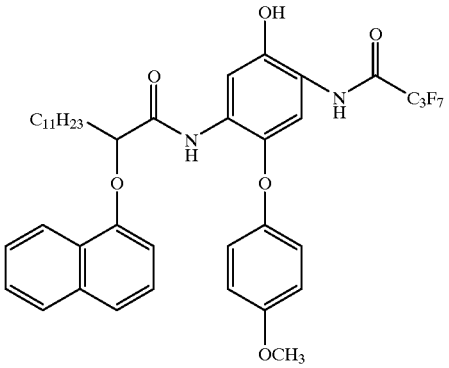
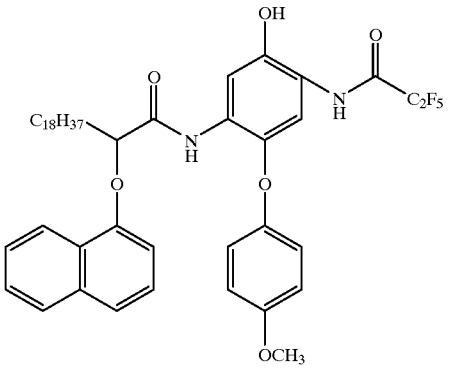
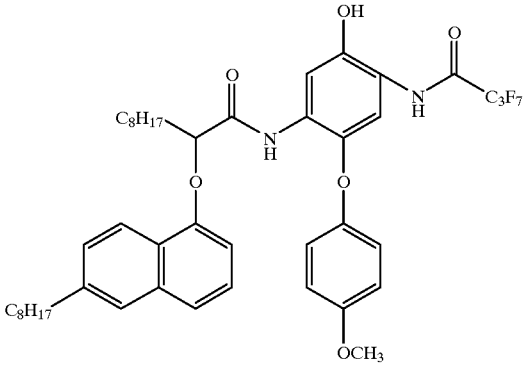
-continued
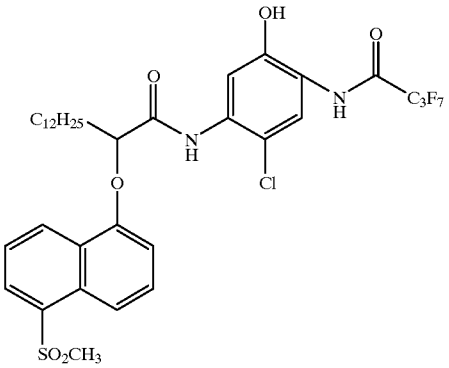
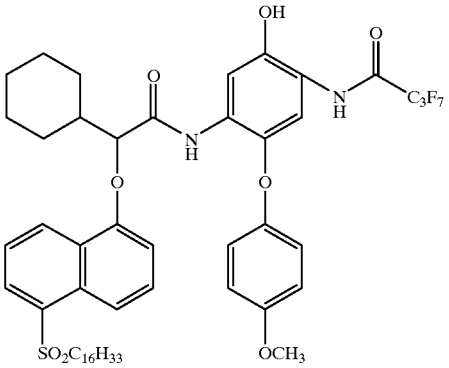
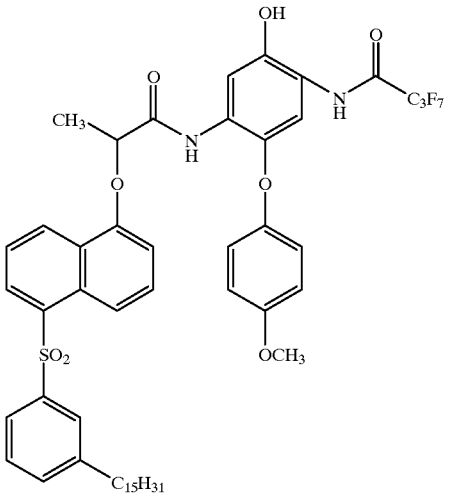
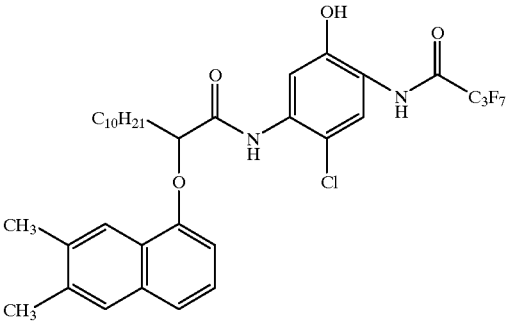

-continued
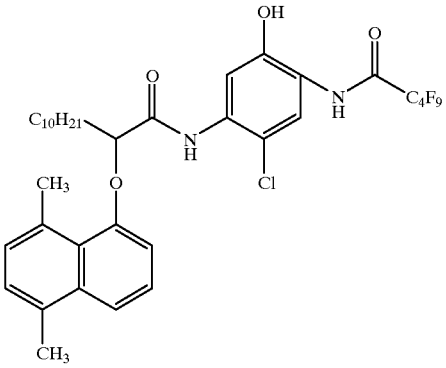
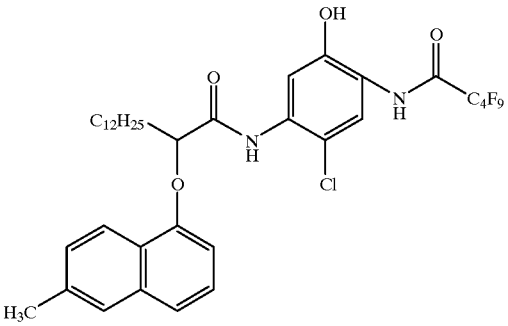
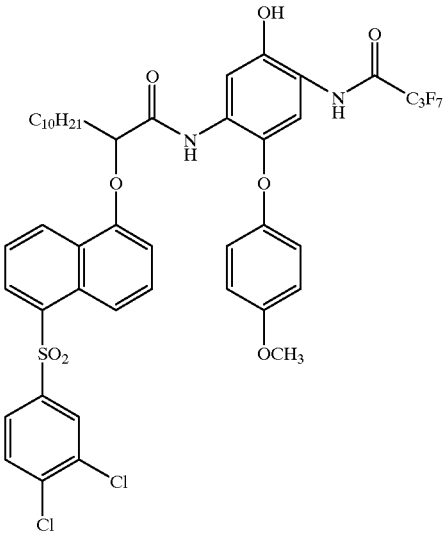
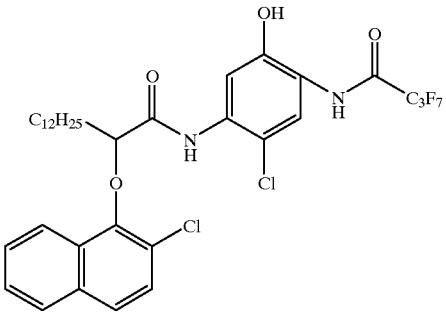
-continued
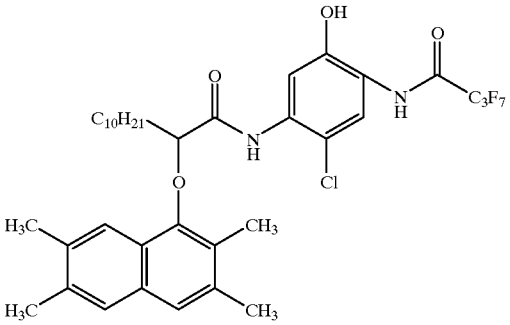
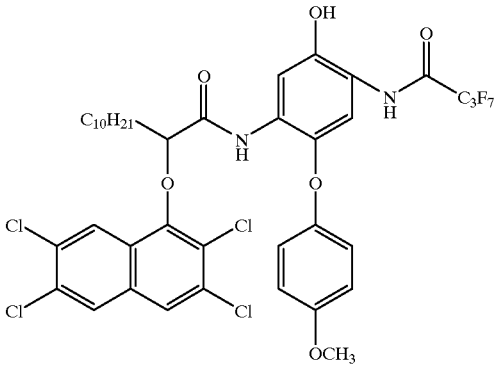
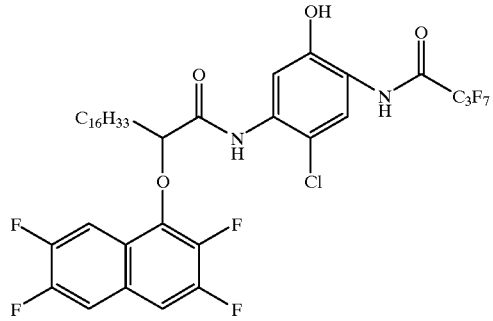
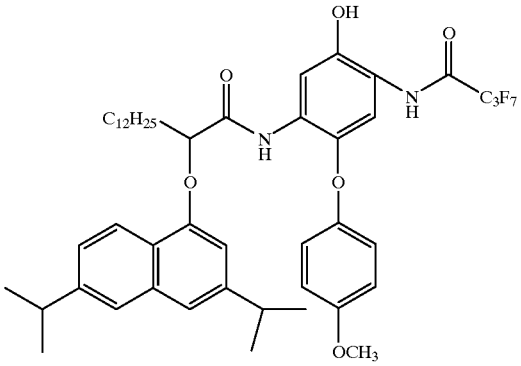

-continued
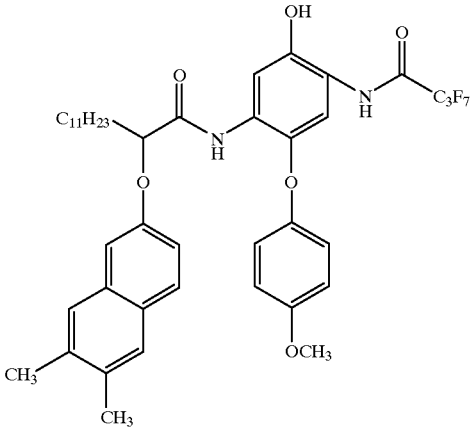
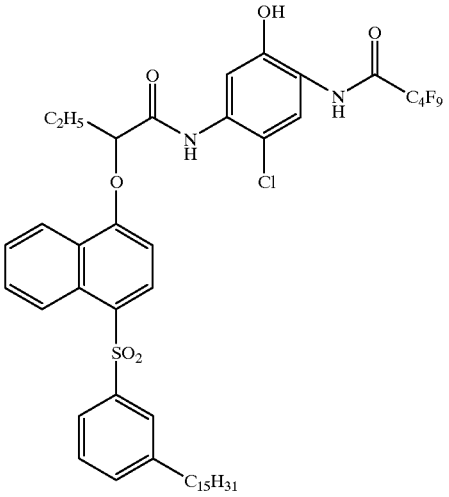
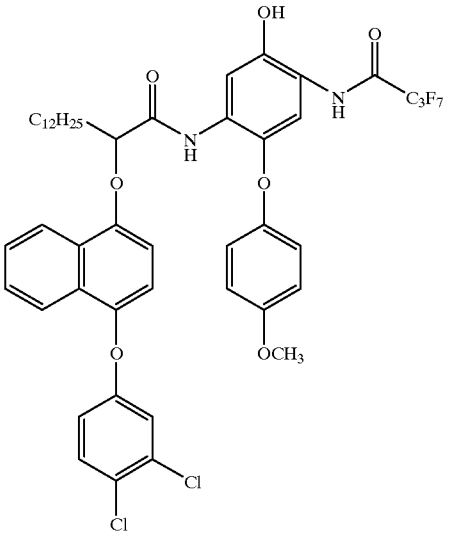
-continued
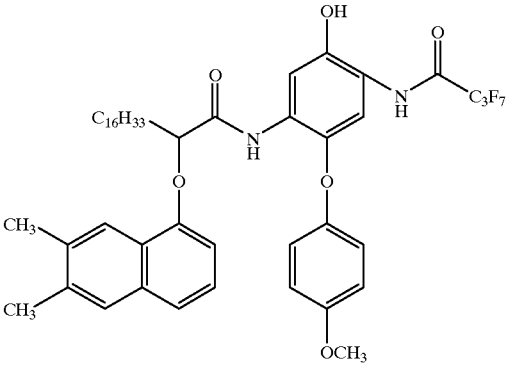
and
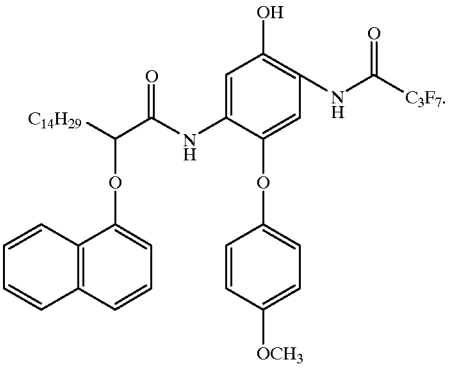
16. The color photographic element of claim 15 wherein said phenolic dye-forming coupler has the structure
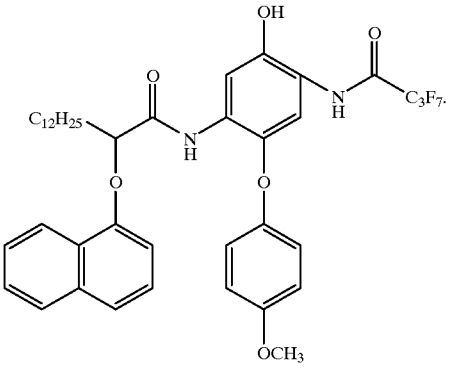
17. The color photographic element of claim 15 wherein said phenolic dye-forming coupler has the structure

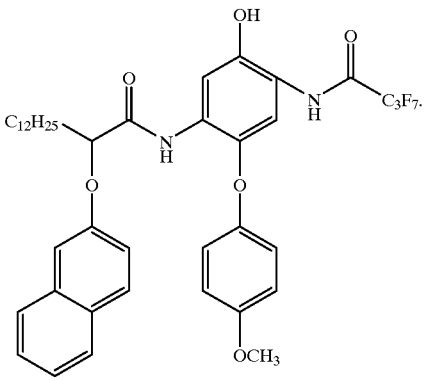
18. The color photographic element of claim 1 that is a negative element which forms a negative image upon exposure and processing.
19. The color photographic element of claim 1 that is a reversal element which forms a positive image upon exposure and processing.
* * * * *